US005416387A

United States Patent [19]

Cuk et al.

[11] Patent Number: 5,416,387

[45] Date of Patent: May 16, 1995

[54] SINGLE STAGE, HIGH POWER FACTOR, GAS DISCHARGE LAMP BALLAST

[75] Inventors: Slobodan Cuk, Laguna Hills; Er Deng, Pasadena, both of Calif.

[73] Assignee: California Institute of Technology, Pasadena, Calif.

[21] Appl. No.: 158,022

[22] Filed: Nov. 24, 1993

[51] Int. Cl.[6] ..... H05B 37/02

[52] U.S. Cl. ..... 315/209 R; 315/219; 315/291; 315/307; 315/308; 315/247; 363/16

[58] Field of Search ..... 315/209 R, 291, 307, 315/308, 247, 248, 219, DIG. 2; 363/16

[56] References Cited

U.S. PATENT DOCUMENTS 4,184,197 1/1980 Cuk et al. ..... 363/16

OTHER PUBLICATIONS

E. E. Hammer, "Fluorescent Lamp Operating Characteristics at High Frequency", Journal of IES, Oct. 1984.

P. Wood, "High Frequency Discharge Lamp Ballasts Using Power MOSFETs, IGBT's and High Voltage Monolithic Drives", PCI Proceedings, pp. 307–324, 1989.

J. Spangler, et al., "Electronic Ballast Using a Power Factor Correction Techniques for Loads Greater Than 300 Watts", APEC 91, pp. 393–399, Mar. 1991.

S. D. Freeland, "Input Current Shaping for Single–Phase AC–DC Power Converters", Ph.D. Thesis, Part II, California Institute of Technology, 1988.

R. L. Steigerwald, "High Frequency Resonant Transistor DC–DC Converters", IEEE Trans. on IE, vol. IE–31, No. 2, May 1984.

*Primary Examiner*—Robert J. Pascal

*Assistant Examiner*—Reginald A. Ratliff

*Attorney, Agent, or Firm*—Antonio M. Fernandez

[57] ABSTRACT

A gas discharge lamp ballast provides near unity power factor simultaneously with high-frequency lamp ballasting in a single switching power conversion stage resulting in efficiency improvements, reduction in size and weight and reduced component count and cost. The single conversion stage comprises a fast-recovery diode connecting in series the input inductor, energy transfer capacitor and the resonant matching network, and switching means alternately connecting the first junction between the input inductor and energy transfer capacitor, or the second junction between the matching network and the other side of said capacitor to the return current path. The switching means comprises two current bidirectional switches driven out of phase, thus producing a square-wave high frequency voltage source, which is in turn converted by the resonant matching network into a sine-wave ac current source required by the gas discharge lamp. The fast-recovery input diode in conjunction with the input inductance chosen to be less than the critical inductance value forces the input inductor current into a new discontinuous inductor current mode (DICM). The average input inductor current is shown to closely follow the rectified line voltage when the ballast is operated at the constant duty ratio and at the constant switching frequency either open-loop or with the slow feedback loop of conventional PWM control. Zero voltage switching for the two current bidirectional switches is achieved by introducing two transition intervals during which both switches are OFF and utilizing the negative value of the lagging current of the matching network above resonance.

26 Claims, 26 Drawing Sheets

PRIOR—ART

PRIOR—ART

PRIOR–ART

PRIOR—ART v in
t
i 1
|iG|
t
Vc
t
iL
t tr1 resonant transition tr2 resonant transition Separate
Filament Heatings On line frequency period Time: 2mS/ Div.

Input inductor current: 0.2A/ Div.

On switching frequency period

Time: 5uS/ Div.

Input inductor current: 0.2A/ Div.

Line voltage (Upper trace)
Line current (Lower trace)
Time: 2mS/ Div.

Lamp current (Lower trace): 0.2A/ Div.
Lamp voltage (Upper trace): 100V/ Div.
Time: 5uS/ Div.

Switch voltage vQ1 (Upper trace): 100V/ Div.
Switch Current iQ1 (Lower trace): 0.5A/ Div.
Time: 5uS/ Div.

Switch voltage vQ1 (Upper trace): 100V/ Div.
Switch Current iQ1 (Lower trace): 0.5A/ Div.
Time: 5uS/ Div.

SINGLE STAGE, HIGH POWER FACTOR, GAS DISCHARGE LAMP BALLAST

FIELD OF THE INVENTION

The invention pertains to a high power factor switching power converter for transforming an input ac line low frequency voltage source into an effective sinusoidal, high frequency ac current source for ac loads, and more specifically to a high power factor, high frequency electronic ballast for gas discharge lamps.

BACKGROUND OF THE INVENTION

Fluorescent lamps play an important role in present-day lighting technology due to their high efficiency, good color rendering and long life. A fluorescent lamp consists of a glass tube with electrodes at both ends, coated on the inside with a phosphor powder. The tube contains a mixture of one or more noble gases (neon, argon, krypton) at a certain pressure and a small amount of mercury vapor. The lamp is operated by maintaining a gas discharge in it, with the help of two electrodes, one at each end of the glass tube. In the discharge, mercury atoms are excited to emit ultraviolet radiation which is transformed to visible light by the phosphor coating on the tube. There are two kinds of lamps, instant strut (cold cathode) lamps and rapid start (hot cathode) lamps. Instant start type lamps have a straight electrode at each end of the lamp, while rapid start lamps have filament coils at each end which need sufficient preheat before the lamp can start without electrode sputtering. The present invention is useful for both types of lamps, with only a slight modification (to provide the filament heating) in the circuit for a rapid start fluorescent lamp. In each case, the ballast is used to stabilize the ac current flow through the lamp.

A problem with fluorescent lamps and other gas discharge lamps is that they cannot be connected directly to a utility power line of 60 Hz (or even 400 Hz on aircraft). They require the addition of a ballast, a typical one of which is shown in the prior-art FIG. 1(*a*) for a cold cathode (instant start) fluorescent lamp 10*a* or a ballast for a hot cathode (rapid start) fluorescent lamp 10*b* shown in FIG. 1(*b*). The ballast consists of two distinct stages: a first stage 11 comprising an ac-to-dc converter utilizing a conventional full-wave bridge rectifier and a boost current shaper having switches Q1 and D1 for high power factor control, and a second stage 12 comprising a resonant inverter having two switches Q2 and Q3 for output current control and a resonant network to provide the sine-wave current source required by the lamp. The ballast is needed both to start the lamp with high enough voltage as well as to set up the stable operating point, since the fluorescent lamp as a circuit element exhibits a negative impedance once it is energized due to its nonlinear (voltage-current) V-I characteristic.

From the discussion above, it is apparent that the ballast is a two-port (four-terminal) network placed between the utility line and the fluorescent lamp which should have the following functions: supply proper starting and operating voltage; maintain the running current at a design value with a low crest factor; regulate the current output against supply voltage variations; and have a high overall efficiency. A relatively new requirement is to maintain a high (near unity) power factor for the ballast. In addition, since a ballast is a commercial product, low cost, high efficiency and high reliability are also required. Two approaches used in the past to meet these requirements and their relative advantages and disadvantages are:

60 Hz magnetic ballasts: The main advantage of a 60 Hz magnetic ballast is its relative simplicity and, at present, lowest cost. The main disadvantage is its large size and weight requirement due to the low frequency operation, and in particular the heavy magnetics and the associated core and copper losses. Another performance disadvantage for fluorescent lamps is the visible flicker as well as audible noise of the lamp's operation due to the 60 Hz operation. Finally, another major deficiency is its low efficacy, i.e., lower light output for the same electrical input than when the lamp is driven with high frequency currents. The relatively poor power factor of this approach is also a disadvantage.

High frequency electronic ballasts: High frequency (20–60 KHz) electronic ballasts have been widely accepted as an improvement over the 60 Hz magnetic ballasts in that they provide much smaller size and weight, higher efficiency, elimination of flicker and elimination of audible noise. In addition, high (almost unity) power factor, together with higher lamp efficacy, have been achieved due to the operation at higher frequencies. An efficient control via duty ratio modulation in the output controller of the switches Q2 and Q3 is also naturally provided which results in a new performance feature for fluorescent lamps of light dimming (continuously adjustable light output) as needed, resulting in extra energy savings. The major disadvantage of the prior-an high frequency electronic ballast is in its increased cost.

In essence, an electronic ballast for a fluorescent lamp or other gas discharge lamp is a circuit that functions as a high frequency current source. Before the lamp turns on, lamp impedance $R_L$ is infinitely large. This current source characteristic thus generates high enough voltage to start the lamp. After the lamp turns on, lamp current is stabilized at the designed value by the ballast. A resonant inverter can be used as a lamp ballast as shown in FIGS. 1(*a*) and 1(*b*) by placing a properly designed LCC band-pass resonant network between the chopped square-wave voltage output of the switches Q2 and Q3 and the fluorescent lamp. A series capacitor Cs of the LCC network is used to block the dc component of the square-wave voltage, while an inductor L2 together with a shunting capacitor Cp and the series capacitor Cs form a series-parallel resonant circuit which provides a current source at its parallel-resonant frequency $\omega_{Par}$ as described below.

Thus, the LCC network in the resonant inverter 12 can be viewed as shown for the instant start lamp of FIG. 1(*a*), is driven by a square-wave voltage source with the magnitude $V_{dc}$ (voltage across the capacitor C1 in FIG. 1(*a*)) and the pulse width $DT_S$. Since the LCC network is a band-pass network which is designed to provide a low crest factor sine-wave output current, approximation can be made by considering the fundamental component at the switching frequency $\omega_s$ only. Therefore, the voltage source can be represented by its fundamental component $\sqrt{2}V_s(D)\mathrm{Sin}(\omega_s t)$ only, where $$V_S(D) = V_{dc}f(D) \text{ and } f(D) = \frac{\sqrt{2}}{\pi}\,\mathrm{Sin}(\pi D). \quad (1)$$

The Norton equivalent circuit of the LCC resonant network includes an ideal current source $i_o=\sqrt{2}I_o(\omega_s)$-Sin($\omega_s t$) and a shunting impedance $Z_o(\omega_s)$ seen by the lamp 10(*a*) in which $$I_O(\omega_S) = \frac{V_S}{Z_S(\omega_S)} \quad (2)$$

where the series branch impedance $Z_s(\omega_s)$ is $$Z_S(\omega_S) = \frac{1}{j\omega_S C_S} + j\omega_S L_2 \quad (3)$$

and the output impedance is $$Z_O(\omega_S) = Z_S(\omega_S) // \frac{1}{j\omega_S C_P}. \quad (4)$$

Therefore, the output impedance $Z_o(\omega_s)$ is $$Z_O(\omega_S) \rightarrow \infty \text{ at } \omega_S = \omega_{Par}, \quad (5)$$

where $$\omega_{Par} = \frac{1}{\sqrt{L_2 C_E}}$$

and $$\frac{1}{C_E} = \frac{1}{C_S} + \frac{1}{C_P}.$$

Thus, the lamp sees a current source and the lamp current $i_L$ (rms. value) is therefore equal to the current source $I_o(\omega_s)$.

It can be shown that once the switching frequency $\omega_s$ and lamp current $i_L$ is specified, the LCC network can be determined by $$C_P = \frac{i_L}{\omega_S V_S(D)}, \; C_S = nC_P \text{ and } L = \frac{n+1\; V_S(D)}{n\;\omega_S i_L}. \quad (6)$$

Note the above results are obtained when all the components are assumed to be ideal, i.e., the non-idealities including saturation voltage of MOSFET switches Q1 and Q2 and the parasitic resistance of reactive components are neglected.

The band-pass characteristic of the LCC network will provide the lamp with the desirable low crest factor sine-wave current. Therefore the LCC resonant network functions as a matching network which transforms the square-wave voltage source at its input to the necessary sine-wave current source to drive the lamp 10*a*. Note that the above two switches Q2 and Q3 must be current bidirectional since the lamp is an ac load and the LCC network processes the ac current. If the input square-wave voltage does not contain any dc component, then a simple L2, Cp parallel resonant network can be used. The current source characteristic at the parallel resonance shown before is suitable to drive the lamp 10*a* which will be interpreted here in terms of the Q factor. For the parallel resonant network L2, Cp, Q is defined as:

$$Q = \frac{R_L}{\omega_{Par} L_2}, \text{ where } \omega_{Par} = \frac{1}{\sqrt{L_2 C_P}}. \quad (7)$$

Therefore, if lamp current $i_L$ increases, lamp impedance $R_L$ will drop since the ionization of the lamp is increased, then Q in Eq. (7) will also drop due to the decrease of $R_L$, which in turn will reduce lamp voltage $V_L$, and finally lamp current $i_L$ is reduced and thus brought back to the designed value and vice versa.

The above resonant inverter is currently one of the most popular ballast topologies due to its minimum component count and inherent current source characteristic at the resonance. Unlike other loads, a fluorescent lamp as a load does not require fast regulation. So the lamp can be driven either open-loop or with slow feedback control. This current source characteristic of a LCC resonant inverter can provide high enough voltage to strike the lamp during ignition and stabilize its running current thereafter.

As noted with reference to FIG. 1(*a*), an instant start lamp 10*a* can be directly connected in parallel with the shunting capacitor Cp of the resonant matching network, while for the rapid start lamp 10*b* shown in FIG. 1(*b*), sufficient preheat of the filaments may be required before the high voltage is applied to start the lamp to avoid the sputtering of the electrodes which reduces lamp life. The preheat procedure can be provided by either setting a small duty ratio D or operating the ballast at higher frequency, such that the resonant circuit is detuned, and no current source is generated to provide the high voltage during the first couple of seconds. Then parallel resonant frequency $\omega_{Par}$ or normal duty ratio D can be resumed to start the lamp.

For the rapid start lamps 10*b*, various filament heating connections including that shown in FIG. 1(*b*) can be used. In some cases, especially for the dimming ballast, constant voltage filament heating is required and may be separately provided to stabilize the discharge. Therefore the above LCC resonant network shown in FIG. 1(*b*) can be modified by various filament heating schemes. In addition, multilamp extensions can be easily made by either cascading single lamps or paralleling resonant matching networks in the second stage each with a single lamp in place such that the ballast can be efficiently utilized and the system cost is reduced.

High power factor is now a required feature due to the new international regulations coming into effect which limits the amount of harmonic distortions on the utility line. The benefits of high power factor include reductions in the rms line current and the line current harmonic distortions so that the utility line can be more efficiently utilized and less polluted. The existing high power factor electronic ballast consists of effectively two cascaded power conversion stages as illustrated in FIGS. 1(*a*) and 1(*b*). The first power conversion stage is designed to provide a high power factor ac-to-dc rectification from the utility line. The second switching power stage is a dc-to-ac converter controlled to provide the necessary high frequency ballasting function Both passive and active high power factor ac-to-dc converters can be used as the first stage to shape the input current, but in each case the ballast consists of two stages in cascade which makes the prior-art ballasts large in size and costly with much less efficiency and reliability than could be achieved with a single-stage ballast having all of the stone desirable characteristics plus a high input power factor approaching unity. It is this plus feature that requires the two-stage ballast configuration of the prior art.

Passive current shapers have the advantage of simple structure but suffer from the size and weight of the line frequency reactive components. In addition, power factor increase or harmonic distortion decrease is not satisfactory. In some cases, the line frequency modulation on the high frequency lamp current can not be eliminated. An active current shaper, such as the boost current shaper 11 shown in FIG. 1(*a*), has the advantage of having a unity power factor and a compact size by processing the input power at the switching frequency, but with the high power factor controller the circuit is complicated and thus expensive. On the other hand, the resonant inverter with the properly designed resonant matching network can be used as the second stage in FIG. 1(*a*). The inverter 12 comprises a pair of current bidirectional switches and an output controller 14 to generate square-wave voltage at the switching frequency and a matching network comprising reactive (resonant) components (such as in an LCC network) to generate the sine-wave current source at the output. For that reason, the resonant inverter comprising two current bidirectional switches and the resonant matching network is a favorite candidate as the second stage of a ballast to drive a fluorescent lamp due to its low component count and simplicity of the output controller for open-loop or closed-loop operation.

The major drawback of all prior-art, high power factor electronic ballasts is that they consist of two cascaded power conversion stages as just described. Clearly, this approach has a number of deficiencies, all of them stemming from the use of the two cascaded power conversion stages:

1. Reduced efficiency due to processing of the input power twice through two stages;
2. Increased size and weight;
3. Doubling the cost and reduced reliability due to the two power processing stages.

SUMMARY OF THE INVENTION

A primary object of the present invention is to provide a single-stage high power factor gas discharge lamp ballast, especially a single-stage high power factor fluorescent lamp ballast.

Another object of the present invention is to provide a single-stage high power factor gas discharge lamp ballast which provides the lamp with sine-wave current thus having low crest factor, ensuring both long lamp life and low radiated EMI.

Yet another object of the present invention is to provide a single-stage high power factor gas discharge lamp ballast free of line frequency modulation at the high frequency lamp current, further reducing lamp current crest factor.

Another object is to provide a single-stage high power factor gas discharge lamp ballast having an extra feature of Zero Voltage Switching (ZVS) for reducing switching losses and noise.

Another object of the present invention is to provide a single-stage high power factor gas discharge lamp ballast having a simple but efficient open-loop or closed-loop control circuit.

Still another object of the present invention is to provide a single-stage high power factor gas discharge lamp ballast having an efficient dimming function for continuously varying the light output.

Yet another object of the present invention is to provide a single-stage high power factor gas discharge lamp ballast with isolation feature and voltage step-up function of the lamp.

And yet another object of the present invention is to provide a single-stage high power factor gas discharge lamp ballast in which both switches required for biphase operation can be implemented with direct drive n-channel MOSFET switches.

Another object of the present invention is to provide a single-stage high power factor gas discharge lamp dimming ballast having minimum switching losses achieved by adding external fast-recovery diodes to the corresponding MOSFET switch.

These and other objects of the present invention are achieved in a single stage, high power factor, gas discharge lamp ballast having a rectified sine-wave line voltage input and comprising a single power conversion stage which converts the rectified sine-wave line voltage (such as 60 Hz or other low frequency) to a square-wave voltage at the high switching frequency (such as 20 kHz or higher switching frequency), which in turn is further converted via a resonant matching network into a sine-wave current source at the switching frequency needed to drive the gas discharge lamp.

The single conversion stage comprising a fast-recovery diode D1 connecting in series the input inductor L1, energy transfer capacitor C and the resonant matching network, and switching means alternately connecting the junction between the input inductor L1 and capacitor C, or the junction between the resonant matching network and the other side of said capacitor C, to the return current path. The switching means comprises two current bidirectional switches Q1 and Q2, such as two MOSFETs, driven out of phase such that when one is ON the other is OFF and vice versa, thus producing a high frequency square-wave voltage source. The resonant matching network in turn converts this square-wave voltage source into a sine-wave current source required by the gas discharge lamp. The resonant matching network also contains a dc blocking capacitor to eliminate any dc component from the gas discharge lamp.

The input current of the conversion stage is dependent on the matching network in the absence of diode D1. However, when the fast-recovery diode D1 is added in series with the input inductor L1, as in the present invention, the input inductor current $i_1$ becomes unidirectional and a new discontinuous inductor current mode (DICM) appears provided the input inductor $L_1$ is chosen to be less than the critical inductance value of $L_{crit}$. On the other hand, the output inductor L2 current $i_2$ is still bidirectional as required by the gas discharge lamp. It is shown that in this new DICM mode of operation, the average input inductor current very closely follows the instantaneous line voltage provided the converter is operated at constant duty ratio, resulting in a simple practical implementation of a near unity power factor at the input. Therefore, both high input power factor and gas discharge lamp ballasting have been fulfilled simultaneously within a single power conversion stage resulting in greater efficiency and reliability, reduced size and weight as well as reduced cost. Since the lamp as a load does not require a fast regulation, a slow feedback loop can be closed from the lamp current to the converter switch duty ratio without degrading the high input power factor.

Current bidirectional switches Q1 and Q2 in their OFF states store the energy on their parasitic capacitances, which is dissipated as a loss the moment the switches are turned ON. Another improvement to this invention is to eliminate this switching loss by transferring this stored charge between the parasitic capacitances of the two switches in such a way that the voltage across the previously open switch is naturally reduced to zero before that switch is turned ON (Zero Voltage Switching—ZVS). This is achieved by introducing two transition intervals during which both switches are OFF and utilizing the negative value of the lagging current of the resonant matching network above resonance.

BRIEF DESCRIPTION OF THE DRAWINGS

FIG. 3(*b*) is a schematic diagram of two implementations of the current bidirectional switches, a n-channel MOSFET or the equivalent, a npn bipolar transistor with an antiparallel diode, and a p-channel MOSFET or the equivalent, a pnp bipolar transistor with an antiparallel diode.

FIG. 6(*b*) is yet another schematic diagram of the first preferred embodiment of the present invention with the extra feature of zero voltage switching of the two n-channel MOSFET switches.

FIG. 13(*c*) is a schematic diagram of LC resonant matching network which can be also adopted as variants of the present invention. FIG. 13(*d*) is a block diagram illustrating how a plurality of lamps may be connected to a single conversion stage (not shown) each with its own resonant matching network.

FIGS. 14(*c*), (*d*) and (*e*) are schematic diagrams of other examples of isolated versions of the LCC resonant matching networks which can also be adopted in the second preferred embodiment of the present invention as shown in FIG. 14(*b*).

FIG. 16(*a*) illustrates a modification of the circuit of FIG. 16 for open-loop operation.

DESCRIPTION OF THE PREFERRED EMBODIMENTS

To facilitate understanding the preferred embodiments to be described below, another prior-art circuit will first be discussed. It is the well known dc-to-dc switching converter disclosed in U.S. Pat. No. 4,184,197 and shown in FIG. 2 with the accompanying waveforms in FIGS. 2(*a*) and 2(*b*). The input switch Q1 is a MOSFET and the output switch D is a diode. In the continuous inductor current mode (CICM), the sum of the input (inductor) current $i_1$ and the output (inductor) current $i_2$ is always positive. The voltages across the input inductor and output inductor are identical during the two intervals of a switching period. Diode D carries the sum of input current $i_1$ and the output current $i_2$. The discontinuous inductor current mode (DICM) occurs when the effective conduction parameter $K_e$ satisfies the condition:

$$K_e < K_{crit} \text{ where } K_e \equiv \frac{2L_e}{R} f_S \text{ and } \frac{1}{L_e} = \frac{1}{L_1} + \frac{1}{L_2} \tag{8}$$

Figure 3:
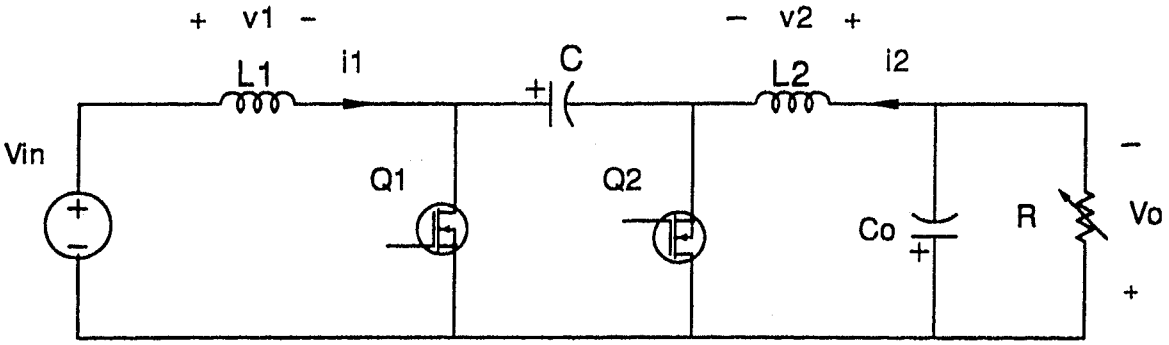
FIG. 3 is a variation of the conventional converter of FIG. 2 with the diode switch D replaced by a MOSFET switch Q2. The waveforms of FIG. 3(*a*) show no DICM exists and inductors L1 and L2 still experience identical voltage wave forms.
Figure 3B:
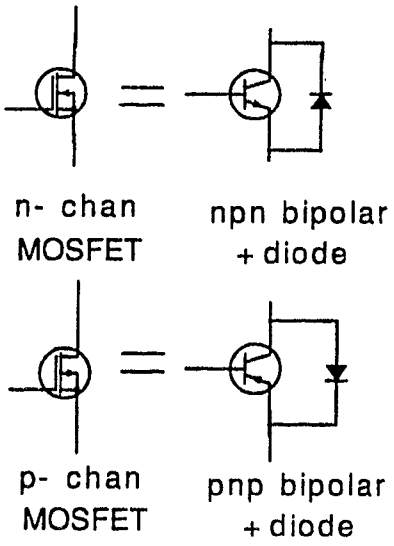
Figure 3A:
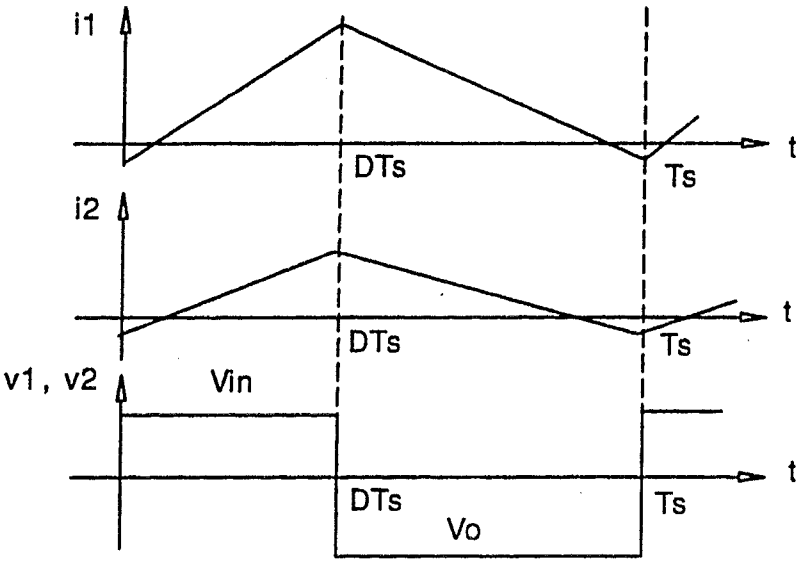
Figures 2, 2A, 2B:
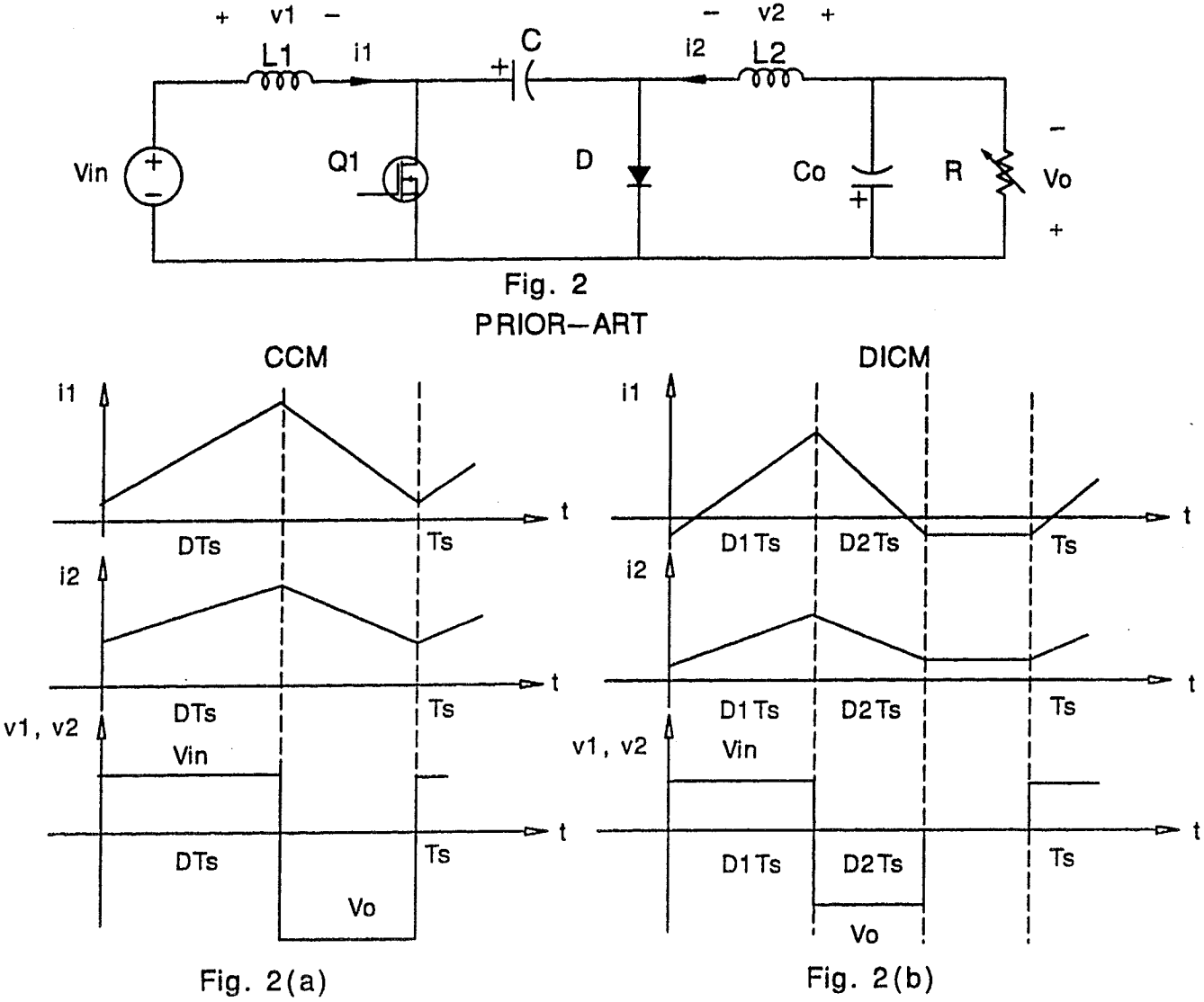
FIG. 2 is a schematic diagram of the conventional dc-to-dc switching converter disclosed in U.S. Pat. No. 4,184,197 and FIGS. 2(*a*) and 2(*b*) show inductor current and voltage waveforms in both continuous inductor current mode (CICM) and discontinuous inductor current mode (DICM) of operation, respectively, where both inductors L1 and L2 share the same voltage waveform.

Under the condition $L_2 > ML_1$, where M is the conversion ratio, $i_2$ is always positive and $i_1$ can be negative as shown in FIG. 2(*b*), thus the sum current drops to zero and a new interval $D_3T_s$ occurs. The voltages across the input inductor L1 and output inductor L2 still share the identical waveform although there are three intervals during a switching period in DICM. On the other hand, operation of a variation of the conventional converter of FIG. 2, in which the output diode D is replaced with a current bidirectional transistor switch Q2 as shown in FIG. 3, is as illustrated in accompanying waveforms in FIG. 3(*a*). Since both input and output currents can take either positive or negative values, this circuit does not permit DICM operation since both MOSFET switches are current bidirectional. As before, the voltages across both inductors L1 and L2 are identical.

The current bidirectional switch can be implemented with either a MOSFET or a bipolar transistor with an antiparallel diode as shown in FIG. 3(*b*). A n-channel MOSFET is equivalent to a npn bipolar transistor with an antiparallel diode and a p-channel MOSFET is equivalent to a pnp bipolar transistor with an antiparallel diode. The above equivalence is to be assumed to be disclosed throughout in the description of the present invention.

Figure 4:
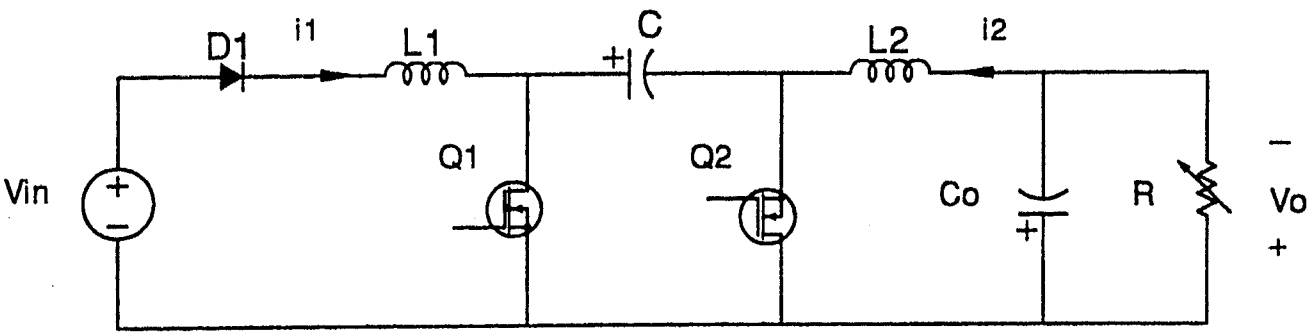
FIG. 4 is a schematic diagram of the modified conventional converter of FIG. 3 in which a fast-recovery diode D1 is added in series with input inductor L1, and FIG. 4(*a*) is a waveform diagram of the input inductor current $i_1$ with and without the diode D1 and output inductor current $i_2$, thus showing by a solid line waveform how a new discontinuous inductor current mode (DICM) is generated for current $i_1$ with the added diode D1 and for an inductor L1 which is chosen to be less than the critical inductance value of $L_{crit}$, as compared to bidirectional current without the diode D1.
Figure 4A:
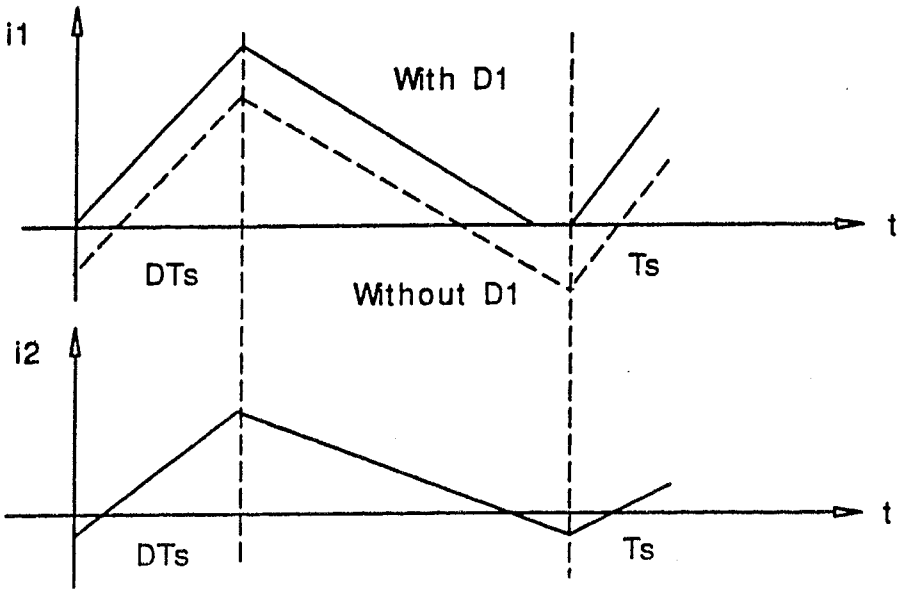

If a fast-recovery diode D1 is inserted in series with the input inductor L1 as shown in FIG. 4 and the inductor L1 is chosen to be less than the critical value of inductance, $L_{crit}$, a new DICM operation is discovered as shown by the wave forms in FIG. 4(*a*). It can be shown that the new DICM operation occurs for the given switching period $T_s$ or switching frequency $f_s$ and dc load R when the input inductor $L_1$ satisfies:

$$L_1 < L_{crit} \text{ where } L_{crit} = \frac{(1-D)^2}{2D} RT_S. \tag{9}$$

The added front-end diode D1 in FIG. 4 does not allow negative input current and forces the input inductor current $i_1$ into a new DICM under the condition of Eq. (9), while the current $i_2$ of the output inductor L2 is still bidirectional due to the two current bidirectional switches Q1 and Q2 and still does not have DICM operation. Thus, the input inductor L1 and output inductor L2 no longer share the identical voltage and cannot be coupled as in the case of the conventional converter of FIG. 2 in the manner described in the aforesaid U.S. Pat. No. 4,184,197.

Note that the operation of the new circuit would be the same if it is operated from a rectified ac line, which turns the dc-to-dc converter into an ac-to-dc converter. It can be shown that for the given switching period $T_s$ and the dc load R, if the input inductor L1 satisfies $$L_1 < L_{crit}, \text{ and } L_{crit} = \frac{(1-D)^2}{4D} RT_S \tag{10}$$

the input inductor current $i_1$ of the converter will always operate in DICM. Automatic input current shaping is thus provided by simply operating the converter at a constant duty ratio and a fixed frequency, and the energy is internally stored in the energy transfer capacitor C. It can be shown the average input current $<i_1>$ is:

$$<i_1> = \frac{V_M}{R_{em}} \sin(\omega_L t) \frac{M}{M - \sin(\omega_L t)} \tag{11}$$

where $$R_{em} \equiv \frac{2L_1}{T_S D_1^2}, \; M \equiv \frac{V_C}{V_M} \text{ and } V_{in} = V_M |\sin(\omega_L t)|$$

Note that the averaging function is provided by the low-pass filter comprising Lf and Cf in the input network as will be shown in the first preferred embodiment Therefore, when the conversion ratio M is large enough, the effect of the nonlinear term in Eq. (11) will be negligible, the average input $<i_1>$ current will nearly follow the input voltage $V_{in}$, where the input resistance is $R_{em}$ and a high (near unity) power factor is achieved. In addition, a conventional feedback loop can be closed from an output sensor back to the switch controller to regulate the output by slow adjustment of the switch duty ratio. The input high power factor is not degraded provided the feedback is slow enough that the duty ratio D in Eq. (11) can be always considered to be constant during each line frequency period. A decoupling feature is provided by the added fast-recovery diode D1 and the condition in Eq. (10), and yet the new DICM operation is the key which makes this topology uniquely suitable to realize both a high power factor at the input and controllable fluorescent lamp ballasting at the output as well as in a single power conversion stage as will now be described.

First Preferred Embodiment

In accordance with a first aspect of the present invention, the ac-to-dc converter described above is converted into a single-stage high power factor gas discharge lamp ballast by replacing the output low-pass network L2, Co with a properly designed LCC bandpass matching network. The front-end fast-recovery diode D1 in series with the input inductor L1 which is chosen to be less than the critical inductance value of $L_{crit}$ forces the input inductor current $i_1$ into the new DICM for the nominal lamp power despite the two current bidirectional switches Q1 and Q2. Automatic input current shaping is provided by simply operating the converter at a constant duty ratio and fixed switching frequency. The average input current nearly follows the input voltage, so a high (near unity) power factor is achieved. A slow feedback loop frown the lamp current to the MOSFET switches Q1, Q2 in the conversion stage can be closed as shown in FIGS. 5, 6(*a*) and (*b*) to regulate the lamp current against the line voltage variations without degrading the input high power factor, as noted hereinbefore.

Figure 5:
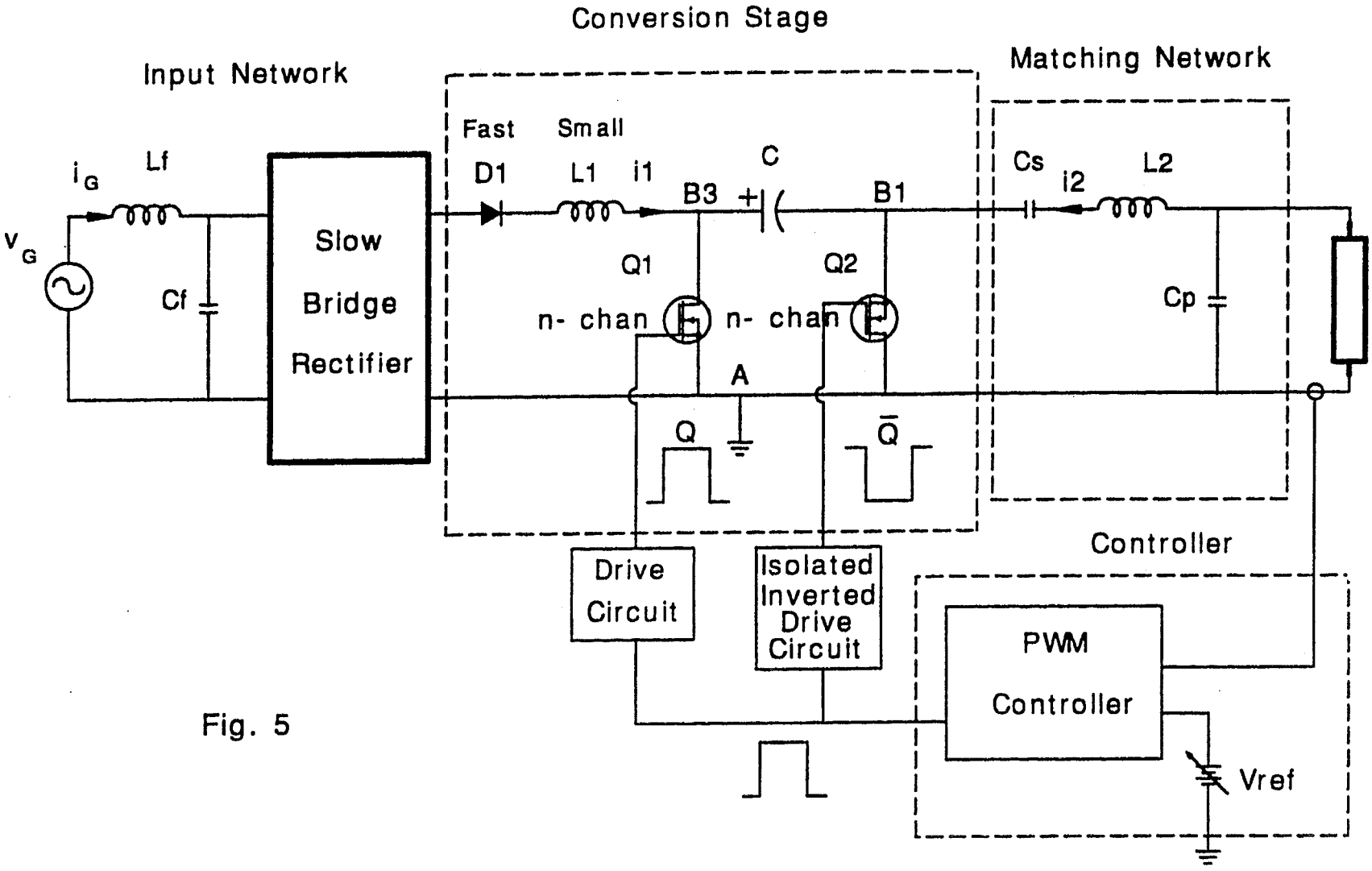
FIG. 5 is a schematic diagram of a first preferred embodiment of the present invention which is based on the converter of FIG. 4 by replacing the low-pass network L2, Co with an LCC resonant matching network at the output where the two current bidirectional switches Q1 and Q2 are both implemented by n-channel MOSFET switches. Note the converter is operated frown the rectified ac line.
Figure 6A:
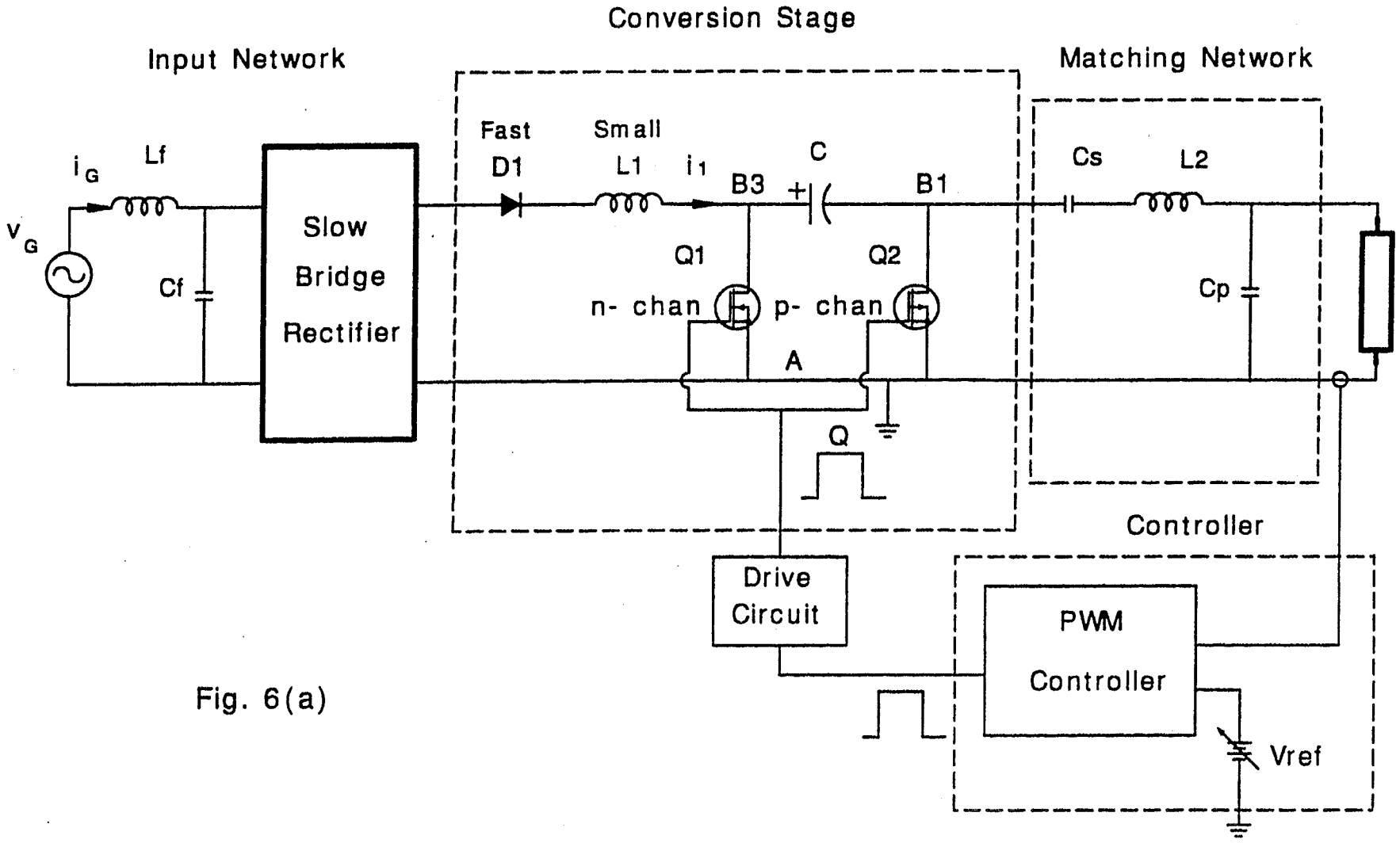
FIG. 6(*a*) is another schematic diagram of the first preferred embodiment of the present invention where the two current bidirectional switches Q1 and Q2 are implemented by a common direct drive n-channel and p-channel MOSFET switches.
Figure 6B:
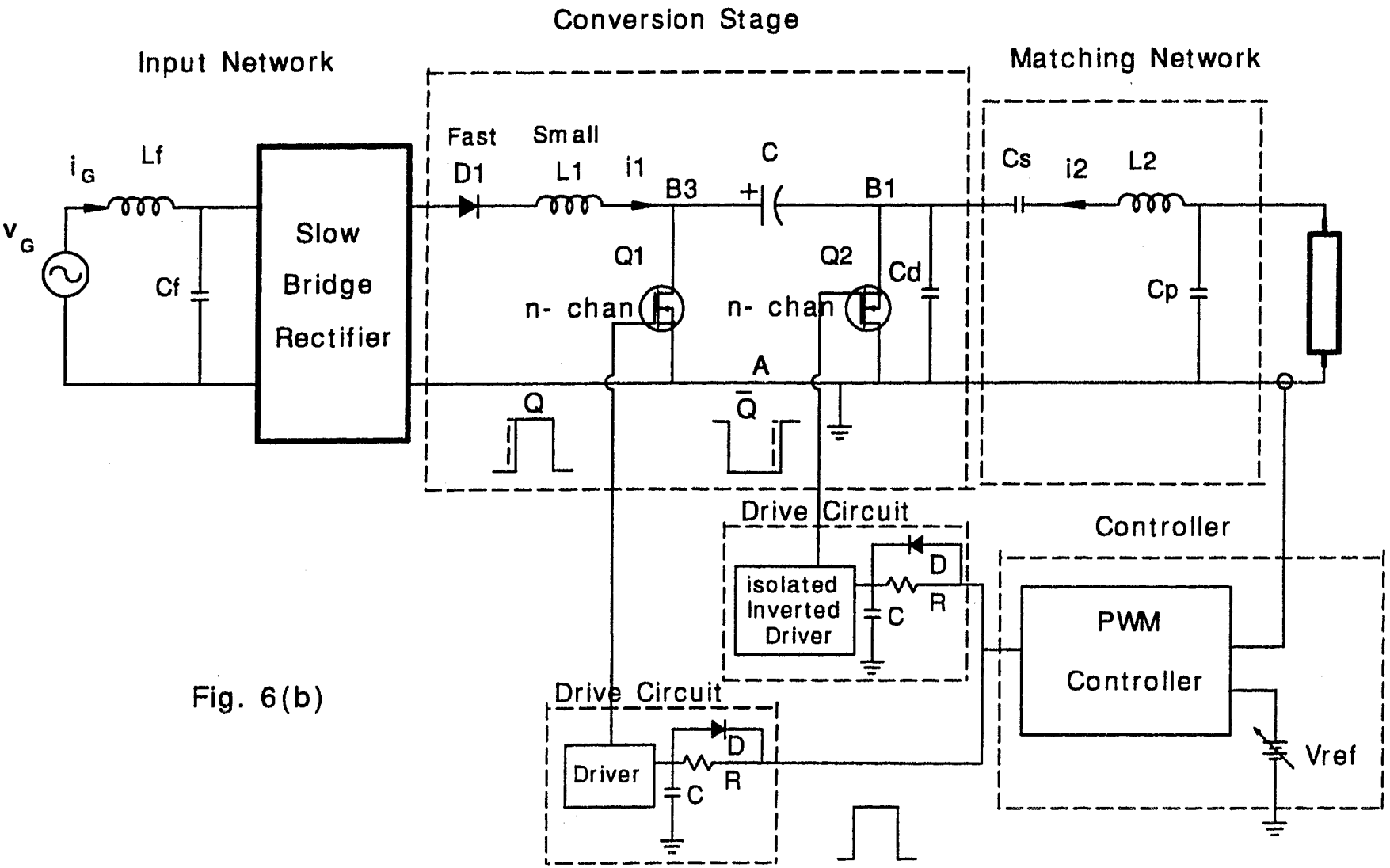

A first preferred embodiment of the present invention is implemented as illustrated in FIG. 5. The single stage high power factor gas discharge lamp ballast comprises four parts as indicated in FIG. 5: a single conversion stage; an input network for coupling an ac power line source to the single conversion stage; a resonant matching network for coupling ac current to a gas discharge lamp; and a fixed frequency, PWM controller (closed-loop as shown or open-loop).

Figure 7A:
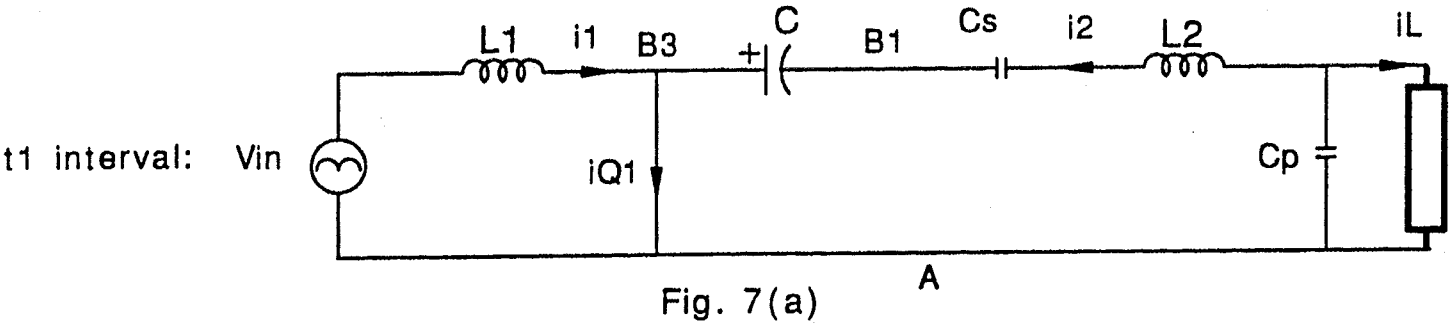
FIGS. 7(*a*), (*b*) and (*c*) show three schematic diagrams of three switched network states of the first preferred embodiment of FIG. 5 during three intervals ($t_1$, $t_2$ and $t_3$) resulting from (a) switch Q1 on, Q2 off, (b) switch Q1 off, Q2 on, and (c) the same as (b) with the fast-recovery diode D1 not conducting.
Figure 7B:
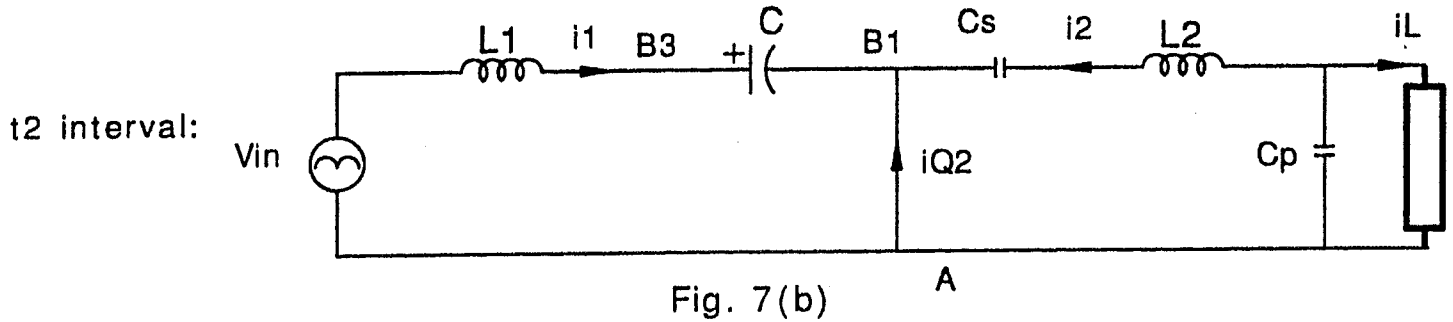
Figure 7C:
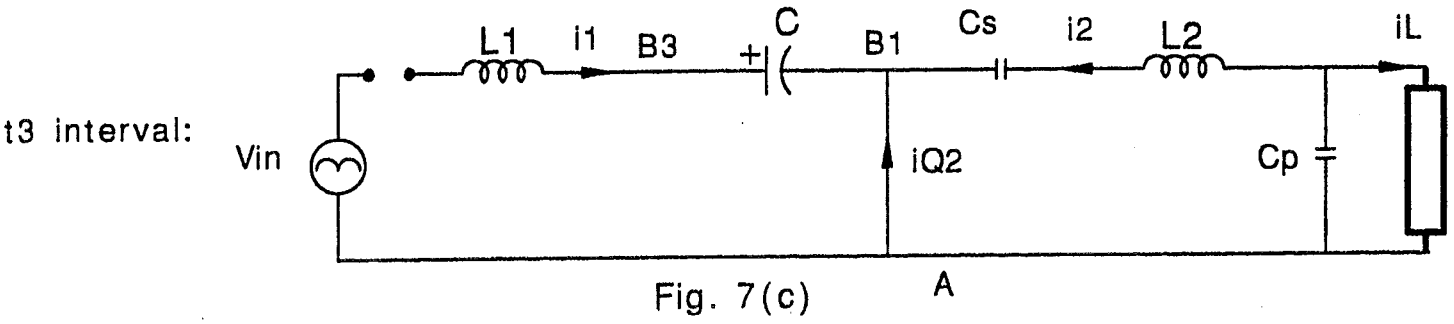

The line voltage $v_G$ is connected to the conversion stage through a low-pass filter Lf, Cf and an ordinary full-wave bridge rectifier of the line frequency ac voltage. The bridge rectifier is provided to convert the line voltage into positive rectified sine-wave voltage and simultaneously unfold the unidirectional input current $i_1$ into the sine-wave line current $i_G$ averaged by the low-pass filter where the undesirable high frequency switching ripple is attenuated. The above line voltage source $v_G$ together with the low-pass filter and the bridge rectifier form the input network of the present invention, which can be simply represented by a full-wave rectified sine-wave voltage source $v_{in}=V_M\cdot|\mathrm{Sin}(\omega_L t)|$ as shown in FIGS. 7(*a*)–(*c*), 13, 14(*a*), (*b*) and FIG. 15.

The output of the rectified voltage source is connected to the front-end fast-recovery diode D1 which is in series with the input inductor L1, while the other end of inductor L1 at point B3, is connected to an energy transfer capacitor C and the drain of a first current bidirectional switch Q1 implemented by a direct drive n-channel MOSFET. The other end of the switch Q1, which is the source of the MOSFET, is connected to a circuit ground A. The other end of the capacitor C at point B1, is connected to the series capacitor Cs and (the source of) the second current bidirectional switch Q2 implemented by an isolated drive n-channel MOSFET, whose drain is connected to circuit ground A. The front-end fast-recovery diode D1, inductor L1, switches Q1 and Q2, and capacitor C comprise the conversion stage of the present invention, which converts the rectified sine-wave line voltage to a square-wave voltage at the switching frequency controlled at the constant frequency shown in FIG. 5 by a PWM controller. It should be noted that in practice, the function of the front-end fast-recovery diode may be shifted to the bridge rectifier by employing fast-recovery diodes in the rectifier, but in practice it is preferable to use slow, less expensive diodes in the rectifier and a single fast-recovery diode at the front end of the single conversion stage.

An LCC resonant network comprising capacitor Cs in series with the inductor L2 and a shunting capacitor Cp that is connected in parallel with the fluorescent lamp load, is the resonant matching network which converts high frequency square-wave voltage to sine-wave current source needed to drive a gas discharge lamp load such as a cold cathode fluorescent lamp 10*a* as shown. Although the ballast can be operated in open-loop at constant duty ratio and constant switching frequency so that an automatic current shaper at the input can be naturally provided, a slow feedback loop can be also closed from a lamp current sensor to the controller of the switch duty ratio without degrading the input high power factor. A commercially available PWM chip can be used as the controller to regulate the lamp current against the line voltage variations. It is important to note that the lamp current can be continuously adjusted by varying the reference voltage of the PWM controller either in closed-loop as shown in FIG. 5 or in open-loop so that light dimming is easily provided.

Both of the current bidirectional switches Q1 and Q2 can be implemented by corresponding npn bipolar transistors with separate anti-parallel diodes as shown in FIG. 3(*b*). One of the MOSFET (or npn bipolar transistor with an antiparallel diode) switches, namely Q2, needs a separate isolated drive since its source is floating, i.e., its source is connected to a junction in the circuit between two capacitors C and Cs. Thus, the problem of overlap conduction of the switches Q1 and Q2 can easily occur if the two drives are not well synchronized. However, the second current bidirectional switch Q2 can be implemented with a p-channel MOSFET and a direct drive circuit as shown in FIG. 6(*a*) or pnp bipolar transistor with an antiparallel diode for small input voltages. Such a direct drive for the switch Q2 will be applicable for the normal input voltage when high voltage p-channel MOSFET or pnp bipolar transistors become available.

In FIG. 6(*a*), both voltage drive connections frown the controller may be referred to ground so that the gates of two opposite conductivity type MOSFETs can be connected together and driven by a common drive circuit. Thus out-of-phase (nonover-lapping) drives can be naturally achieved because of the inverted polarity of the switch Q2 as compared to that of the switch Q1. That arrangement of FIG. 6(*a*) eliminates the problem of overlapping conduction of the two switches.

Figure 8A:
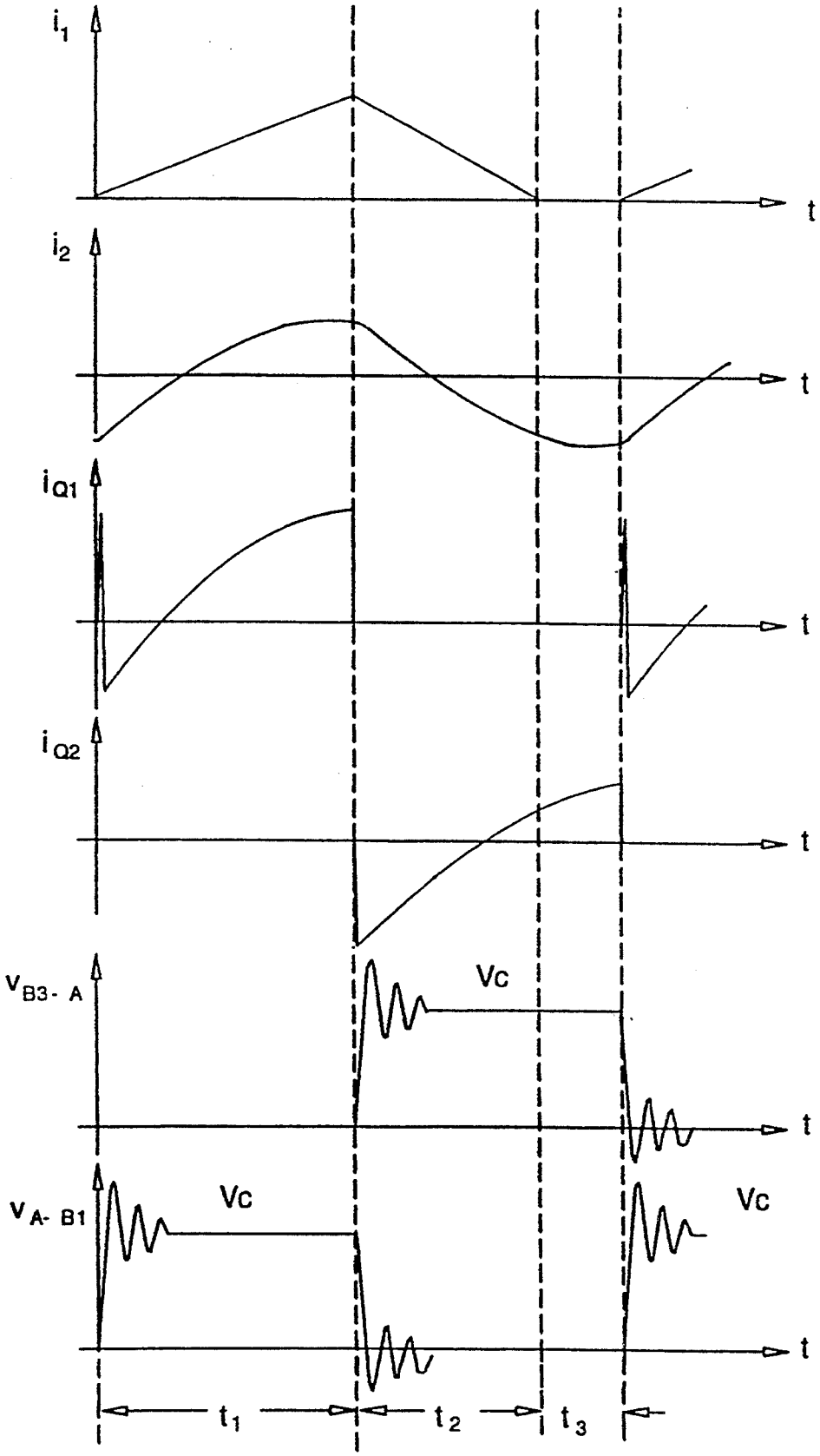
FIGS. 8(*a*) and (*b*) are waveform diagrams accompanying switched networks in FIGS. 7(*a*), (*b*), (*c*) which help to understand operation of the first preferred embodiment of the present invention shown in FIG. 5.
Figure 8B:
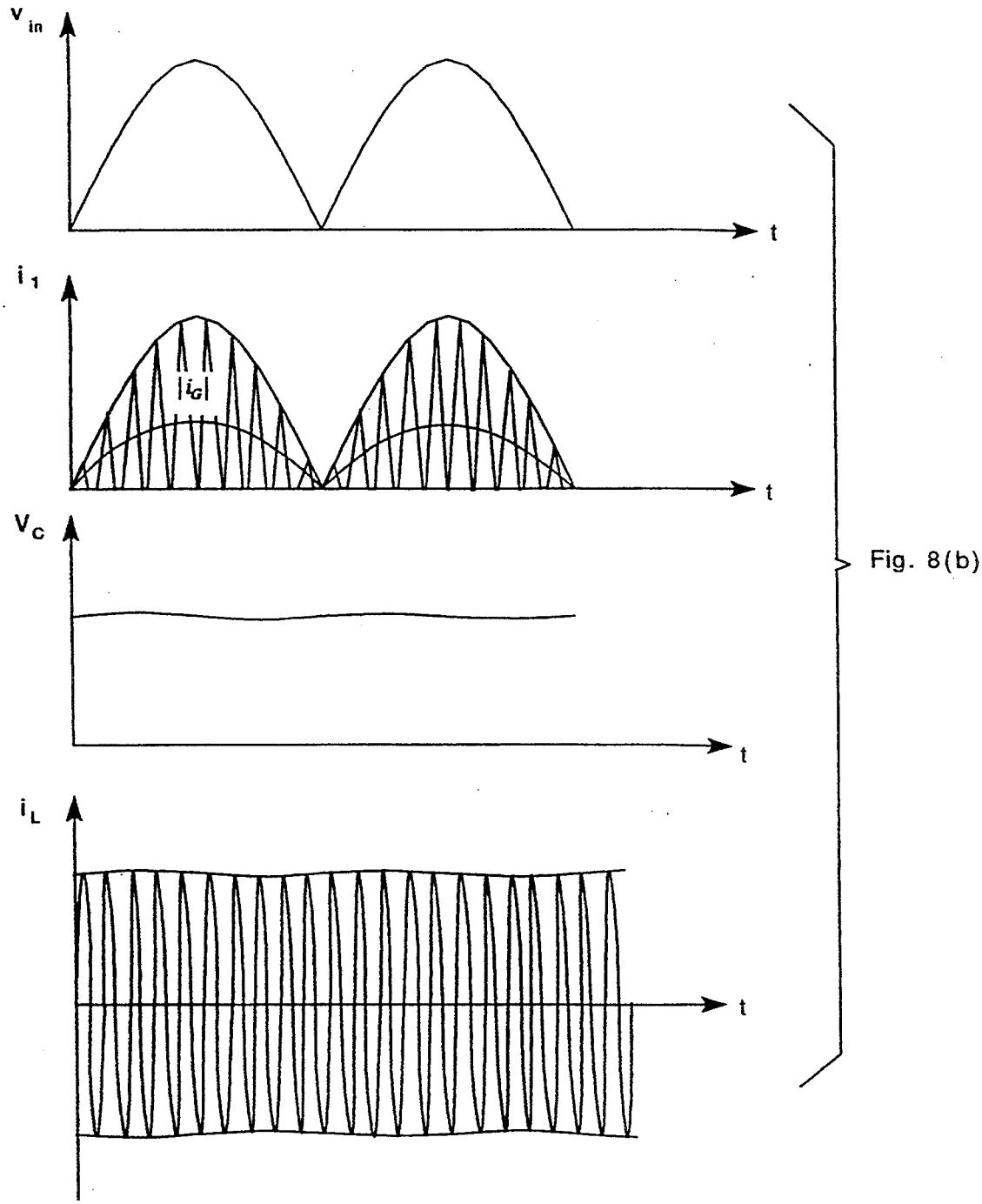

The present invention includes three switches: the front-end fast-recovery diode D1 and switches Q1 and Q2 of the conversion stage. These switches generate three switched networks within one switching period of the controller, as will be described with reference to FIGS. 7(*a*), (*b*) and (*c*) in order to best understand the present invention. Key waveforms are shown in FIGS. 8(*a*) and (*b*). In the following description, all components are considered to be ideal. Nonideal factors such as saturation voltage of the MOSFET switches or parasitics of the reactive components will be neglected as a simplification. Also the lamp ballast of FIG. 5 is assumed to be operated at or around the nominal lamp power (i.e., with the lamp not significantly dimmed).

During the first interval $t_1$ shown in FIG. 7(*a*), switch Q1 closes and the input current $i_1$ through the input inductor L1 linearly increases as the input voltage $v_{in}$ is applied across L1. Meanwhile, the energy transfer capacitor C is connected to the ground A, point B1 and provide the dc voltage $V_c$ across the LCC resonant matching network. Capacitor Cs is charged by this voltage source. The resonant current $i_2$ through the inductor L2 first flows reversely from left to right, then become positive as the arrow shows since the current lags behind the applying voltage $V_c$. The MOSFET switch Q1 carries the sum of the current $i_1$ and $i_2$, so the switch current $i_{Q1}$ flows from negative to positive during $t_1$. The relatively slow MOSFET body diode is feasible since there is no voltage immediately applied after it turns off. The voltage $v_{B3-A}$ across the switch Q1 remains zero if the saturation voltage drop can be neglected. When the switch Q1 is turned off after a time period $t_1$ determined by the PWM controller, Q2 is turned on and the second interval of the switching period begins as shown in FIG. 7(*b*). During this interval, the voltage across the L1 is then $v_{in}-V_c$, the current $i_1$ decreases linearly and the energy transfer capacitor C is charged. The voltage across the open switch Q1 is $V_c$ and the voltage $v_{A-B1}$ across the switch Q2 is zero. Meanwhile, current $i_2$ reverses to be negative and dc blocking capacitor Cs is discharged. When the input current $i_1$ drops to zero and blocked by the diode D1, i.e., D1 becomes open, the third switched network of the third interval $t_3$ starts as shown in FIG. 7(*c*). During $t_3$, the inductor L1 current $i_1$ continues to be zero and the energy transfer capacitor C is idled, while the rest of the network remains the same as in interval $t_2$. Then when the switching period ends, Q2 is turned off again. During intervals $t_2$ and $t_3$, current $i_{Q2}$ also flows from negative to positive, which eliminates the reverse recovery problem of the relatively slow body diode of the MOSFET as in $t_1$. When switch Q1 is turned on, the next switching cycle begins with an interval $t_1$.

The wave forms of $i_1$, $i_2$, $i_{Q1}$, $i_{Q2}$, $v_{B3-A}$, $v_{A-B1}$ are illustrated on the switching period scale in FIG. 8(*a*) as to help understanding the operation of FIG. 5 during the three intervals. The onset of the switched network in interval $t_3$ symbolizes the new DICM operation of the input inductor L1.

Intuitively, a smaller value of inductance L and larger value of switching period Ts tends to move the circuit into DICM operation of the inductor L1. In addition, smaller values of lamp load impedance $R_L$ also makes the circuit go into DICM operation since the output of the lamp ballast is a current source which is opposite to the that of voltage regulator. Therefore, a new parameter Z with a dimension of impedance can be defined as to reflect the effect of the circuit parameters on the operation mode, where:

$$Z = \sqrt{\frac{LR_L}{T_S}} \tag{12}$$

This parameter plays a key role in the DICM, since it combines uniquely all the parameters responsible for such behavior. It can be shown that the critical condition for the ballast operating in the DICM is:

$$Z < Z_{crit} \text{ where } Z_{crit} = \frac{\sqrt{D}\,(1-D)}{2}\;\frac{Z_S(\omega_S)}{f(D)} \tag{13}$$

Once the switching frequency $f_s$ and the nominal lamp load $R_L$ are given, the critical condition could be illustrated in terms of the critical inductance $L_{crit}$, $$L < L_{crit}, \text{ where } L_{crit} = \frac{Z_{crit}^2}{R_L}\,T_S \tag{14}$$

Therefore, if the input inductance value $L_1$ is chosen to be less than the critical inductance $L_{crit}$, the new DICM operation of input inductor current $i_1$ occurs resulting in an automatic current shaping as described next.

The peak of the current $i_1$ during each switching period is modulated by the rectified line voltage $v_{in}$, so the line current $i_G$ obtained by taking the average of the unfolded $i_1$ on the switching period nearly follows the line voltage simply by operating the converter at a constant duty ratio. Thus the near unity power factor is achieved as described previously. The energy transfer capacitor C, which also stores energy, balances the power difference between the high power factor line frequency ac input and high frequency ac lamp output. Since the input power is in the form of $P_i\mathrm{Sin}^2(\omega_L t)$, which is not a constant for a high quality input current shaper, the voltage $V_c$ across the energy storage capacitance C would have modulation of double the line frequency. However, this line frequency ripple can be effectively reduced by increasing the value of the energy storage capacitance C. Therefore the resonant matching network sees the square-wave voltage provided by the energy transfer capacitor C via two current bidirectional switches operating at the constant duty ratio. Since the two switches Q1 and Q2 are both current bidirectional, the LCC resonant matching network in FIGS. 7(*a*), (*b*), (*c*) transforms a square-wave voltage source into a sine-wave current source to drive the lamp which is free of line frequency modulation. Thus, the circuit described above fulfills the function of a single-stage, high power factor, gas discharge lamp ballast. The wave forms of $V_c$, $i_1$, $i_G$, $v_{in}$ and lamp current $i_L$ for the ballast are illustrated in FIG. 8(*b*) on the line scale.

The above described switching process in FIGS. 7(*a*), (*b*), (c) and FIG. 8(*a*) of the present invention is called hard switching since the current bidirectional switches Q1 and Q2 in their OFF state store the energy $$\frac{1}{2}\,C_q V_C^2$$

on their parasitic capacitances Cq (both Cq1 and Cq2), which is dissipated as a loss the moment the switches turned ON. This loss of $$\frac{1}{2}\,C_q V_C^2 f_S$$

is proportional to the switching frequency and therefore represents the major obstacle for reducing the size and weight via switching frequency increase. This switch turn-on loss due to the capacitor charge dumping results in current spikes and voltage overshoots as shown in FIG. 8(*a*). As a consequence, high voltage ratings are needed for the semiconductor switches and ringing of the current spikes and voltage overshoots causes losses. EMI noises can be also generated by the above current spikes and the associated voltage overshoots. However, all these disadvantages can be eliminated by the extra feature of zero voltage switching (ZVS or soft switching) of the two MOSFETs which will now be described.

Figure 9B:
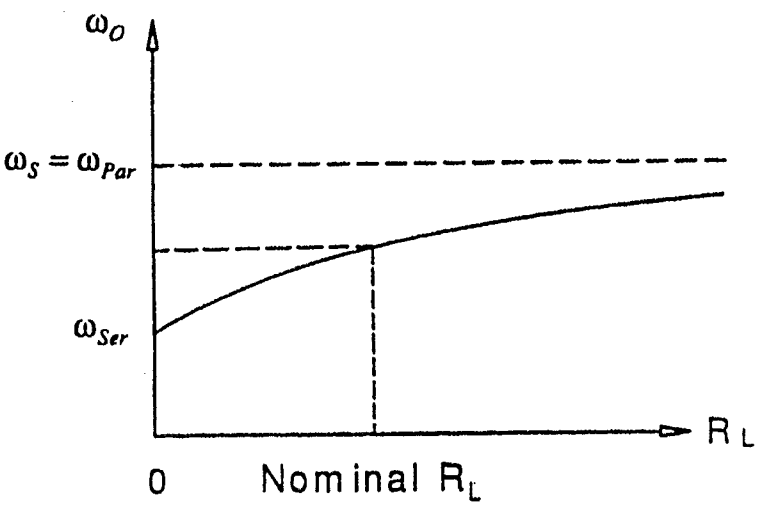
FIG. 9(*a*) is a schematic diagram of an LCC resonant matching network, and FIG. 9(*b*) is a graph which helps to understand the relationship between resonant frequency $\omega_o$ of the LCC network and load RL.
Figure 9A:
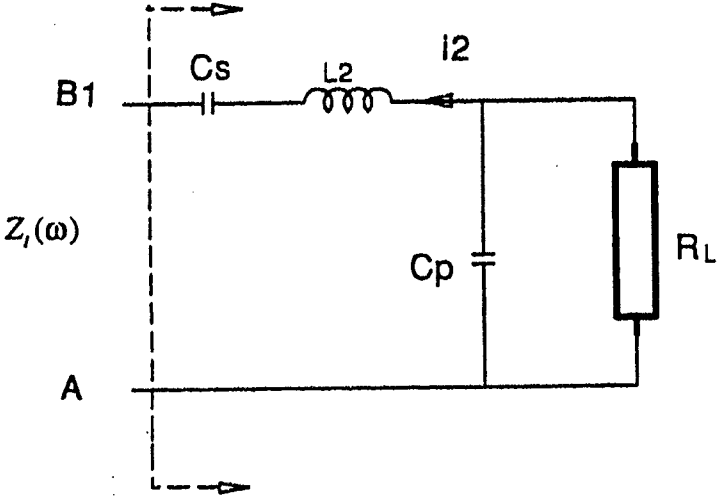

The extra feature of zero voltage switching of MOSFET switches is provided by utilizing the lagging current of the LCC resonant matching network obtained by operating the resonant circuit above resonance. As in FIG. 6(*b*), the function of the series capacitor Cs is to block the dc component of the square-wave voltage across the points A and B1 while the inductor L2 together with the shunting capacitor Cp and the series capacitor Cs form a series-parallel resonant network which provides the necessary current source at the parallel resonance to drive the fluorescent lamps as described before. On the other hand, the resonant frequency $\omega_o$ of the LCC network can be defined in terms of the input impedance $Z_1(\omega)$ where:

$$Z_1(\omega) = \frac{1}{j\omega C_S} + j\omega L_2 + \frac{1}{j\omega C_P} // R_L \quad (15)$$

which is illustrated in FIG. 9(*a*), i.e., the resonant frequency $\omega_o$ is the frequency when $Z_1(\omega)|_{\omega=\omega_o}$ is resistive. Before the lamp rams on, the impedance of the lamp is infinitely large and the LCC resonant circuit is non-loaded. The non-load resonant frequency $\omega_o$ is the parallel resonant frequency $\omega_{Par}$ determined as the following:

$$\omega_O = \omega_{par} = \frac{1}{\sqrt{L_2 C_E}} \text{ where } C_E = \frac{C_S C_P}{C_S + C_P} \quad (16)$$

Therefore, if the switching frequency is set at the $\omega_{Par}$, the lamp will see a current source since the output impedance of LCC matching network at the parallel resonance is infinitely large as shown in Eq. (5). This current source characteristic, which is the function of the matching network, will start the lamp and then stabilize its running current. After the lamp is turned on, however, its impedance drops and the series-parallel resonant circuit is loaded by the lamp impedance $R_L$. Therefore, the resonant frequency $\omega_o$ will be reduced below $\omega_{Par}$, As an extreme, when the lamp load shorts or $R_L=0$, the resonant frequency $\omega_o$ will be the lowest which is the series resonant frequency $\omega_{Ser}$ determined by:

$$\omega_{Ser} = \frac{1}{\sqrt{LC_S}} \quad (17)$$

Thus, after the lamp is turned on, the LCC network is nonzero loaded and the resonant frequency is somewhere between $\omega_{Ser}$ and $\omega_{Par}$. The relation of resonant frequency via the load $R_L$ is plotted in FIG. 9(*b*). Since the switching frequency or operating frequency $\omega_s$ is set near $\omega_{Par}$, which is the upper bound of the resonant frequency, after the lamp turns on, the lamp ballast is operated above resonance, as shown in FIG. 9(*b*) which means the input impedance $Z_1(\omega_s)$ of the resonant circuit is inductive and the current $i_2$ lags behind the voltage $v_{A-B1}$ at the input port A–B1 of the resonant matching network. It is this lagging current which provides a desirable feature of the present invention, namely zero voltage switching (ZVS) transition of the MOSFETs.

As previously described, the single-stage high power factor gas discharge lamp ballast of the present invention contains three switches: D1, Q1 and Q2 which make the converter a three switched network for the three intervals in a switching period under the condition of Eq. (13). In addition, two resonant transition intervals ($tr_1$ $tr_2$) are also required to facilitate ZVS of the two MOSFETs. These two resonant transitions during $tr_1$ and $tr_2$ will be described in order to best understand how the extra feature of ZVS is obtained in the single-stage high power factor gas discharge lamp ballast, with the corresponding schematic diagrams of FIGS. 10(*a*) and (*b*) where each current bidirectional switch is represented by a composite switch, consisting of an active switch Q, an antiparallel diode Dq and the parasitic capacitance Cq. The key wave forms are illustrated in FIG. 11 on the switching period scale. Note the ballast is assumed to be operated around nominal conditions (i.e., input line voltage variation is not large, lamp is not significantly dimmed and duty ratio is close to 0.5).

Figure 10A:
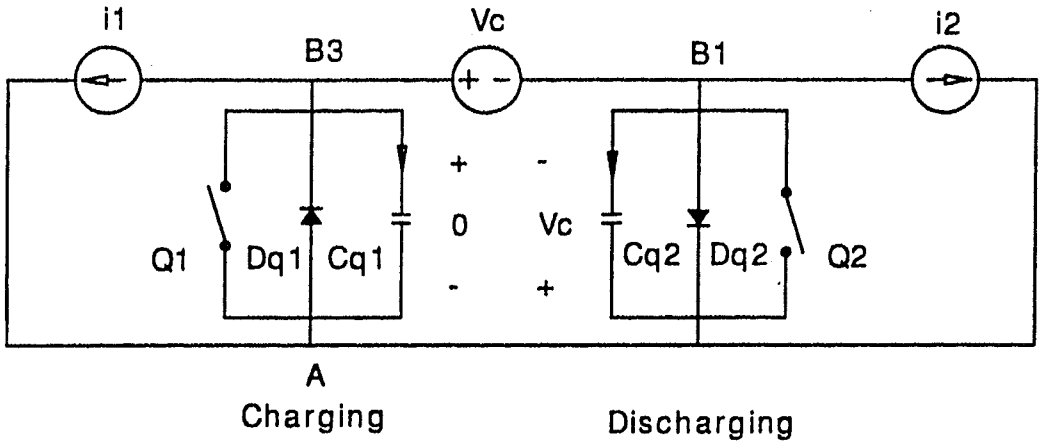
FIGS. 10(*a*) and (*b*) are schematic diagrams describing two resonant transitions during two transition intervals ($tr_1$ and $tr_2$) of the first preferred embodiment of FIG. 6(*b*), which help to understand the extra feature of zero voltage switching of the two MOSFET switches Q1 and Q2 in the first preferred embodiment of FIG. 6(*b*).
Figure 10B:
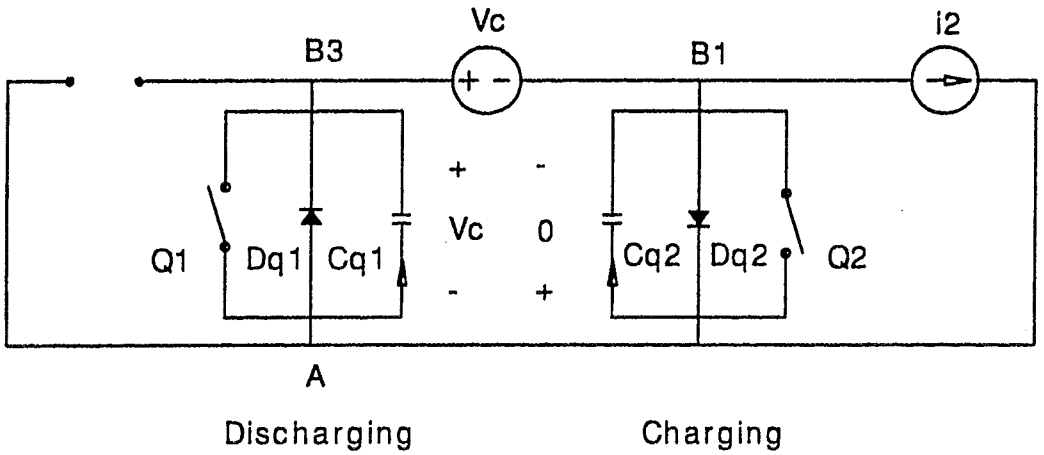
Figure 11:
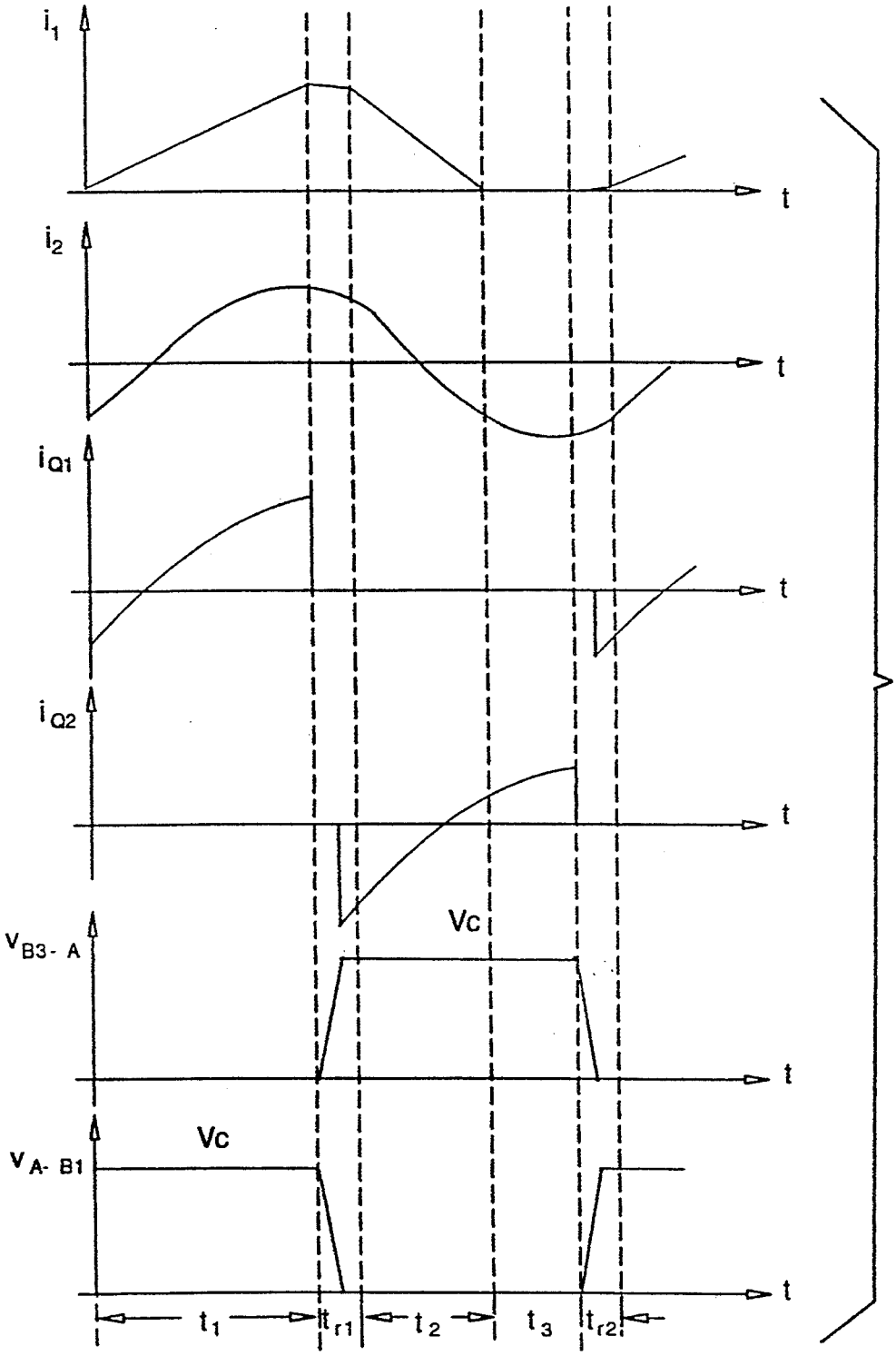
FIG. 11 is a waveform diagram also describing the two resonant transitions during two transition intervals ($tr_1$ and $tr_2$) in FIGS. 10(*a*) and (*b*), which also helps to understand the extra feature of zero voltage switching of the first preferred embodiment of FIG. 6(*b*).

Since the duration of two resonant transitions ($tr_1$ and $tr_2$) are short compared to the switching period, inductor currents $i_1$, $i_2$ and capacitor voltage $V_c$ could be assumed constant during the two resonant transitions and represented by the dc current and voltage sources i1, i2 and Vc respectively as shown in FIGS. 10(*a*) and (*b*).

The first resonant transition interval $tr_1$ starts when the active switch Q1 turns off, i.e., when $t_1$ interval as shown in FIG. 7(*a*) ends. During the first resonant transition interval $tr_1$, input inductor (L1) current $i_1$ is at its peak as shown in FIG. 11 while resonant inductor (L2) current $i_2$ is also positive as shown in FIG. 11 due to the phase lag with respect to the voltage $v_{A-B1}$ as described before. Therefore the two inductor currents $i_1$ and $i_2$ can be represented by the corresponding dc current sources i1, i2 respectively, as illustrated in FIG. 10(*a*), where Vc is a dc voltage source representing voltage across the energy transfer capacitor C. The sum current i1+i2 splits and charges and discharges the two capacitors Cq1 and Cq2 simultaneously. Thus after Q1 turns off, capacitor Cq1 is charged and its voltage $V_{B3-A}$ rises linearly from its initial value of zero as shown in FIG. 11, while capacitor Cq2 is simultaneously discharged and its voltage $V_{A-B1}$ drops linearly frown its full turn-off value of $V_c$ also as shown in FIG. 11 until it reaches zero level when the antiparallel diode Dq2 conducts, then voltages $V_{B3-A}$ and $V_{A-B1}$ are clamped at the $V_c$ and zero level respectively. Therefore switch Q2 can be now turned on losslessly since $V_{A-B1}$ is clamped at zero level and energy stored in Cq1 has been transferred into Cq2. After Q2 turns on, the circuit starts its second interval $t_2$ as described previously in FIG. 7(*b*).

The second resonant transition interval $tr_2$ starts when the active switch Q2 turns off, i.e., when $t_3$ interval as shown in FIG. 7(*c*) ends. During the second resonant transition $tr_2$, input inductor current $i_1$ is zero as shown in FIG. 11 due to the DICM operation of L1 while the output resonant inductor current $i_2$ is now negative also as shown in FIG. 11 due to the phase lag with respect to the voltage $v_{A-B1}$ as described before. Therefore the input current is open and the resonant inductor $i_2$ can be represented by the corresponding dc current sources i2, as illustrated in FIG. 10(*b*), where Vc is a dc voltage source representing voltage across the energy transfer capacitor C. The current i2 splits and charges and discharges the two capacitors Cq2 and Cq1 simultaneously. Thus after Q2 turns off, capacitor Cq2 is charged and its voltage $V_{B3-A}$ rises linearly from its initial value zero as shown in FIG. 11, while capacitor Cq1 is simultaneously discharged and its voltage $V_{B3-A}$ drops linearly from its full turn-off value of $V_c$ as shown in FIG. 11 until it reaches zero level when the antiparallel diode Dq1 conducts, then voltages $V_{A-B1}$ and $V_{B3-A}$ are clamped at the $V_c$ and zero level respectively. Therefore switch Q1 can be now turned on losslessly since $V_{B3-A}$ is clamped at zero level and energy stored in the capacitor Cq2 has been transferred into Cq1. After Q1 turns on, the circuit goes to another switching cycle starting from its first interval $t_1$ as described previously in FIG. 7(*a*).

During the above-described resonant transitions of the MOSFETs, each switch is turned on after its parasitic capacitor is fully discharged. It is these two resonant transition intervals which provide the time for the voltage of in-coming turn-on switch to linearly drop to zero level and the energy stored in the parasitic capacitance is transferred into the turn-off switch. Thus, the energy $$\frac{1}{2} C_q V_C^2$$

stored in the capacitance Cq1 and Cq2 is exchanged between each other instead of being dissipated into heat for every switching cycle as in the hard switching process due to the capacitor charge dumping. Therefore, zero voltage turn-on and turn off are implemented so that switch turn-on loss is eliminated and switch turn-off loss is significantly reduced.

From above analysis, it also can be seen that ZVS for the two switches is not symmetrical since during the first transition interval $tr_1$ i1 assists i2 (actually i1>i2) to implement ZVS of switch Q2 while during the second transition interval $tr_2$ only i2 is available to implement ZVS of Q1. Therefore second resonant transistion interval $tr_2$ is usually longer than the first resonant transition interval $tr_1$.

The above description shows turn-on switching losses in the power switch Q2 have been eliminated, which also allows extra lossless snubber capacitance in the form of a discrete capacitor $C_d$ to be added to Cq, i.e., to be placed directly across the switch Q1 or Q2 as shown in FIG. 6(*b*) to reduce the turn-off loss since no capacitor charge dumping is experienced. In addition, the slow body diode of MOSFETs can be fully utilized since there is no voltage immediately applied due to the conduction of the MOSFET after the body diode turns off. If bipolar transistors are used, relatively slow discrete diodes can be added as antiparallel diodes. ZVS of the two MOSFETs significantly reduces the switching loss and the associated noise since the parasitic capacitor Cq charge dumping has been eliminated at turn-on and voltage overshoot is reduced at the switching transitions. The wave forms of $i_1$, $i_2$, $i_{Q1}$, $i_{Q2}$, $v_{B3-A}$, $v_{A-B1}$ are illustrated in FIG. 11 on the switching period scale in order to help understand the above description of operation.

A simple polarized RC time delay network in the switch drive circuits shown in FIG. 6(*b*) is adopted for the switches Q1 and Q2 to provide the delayed turn-on of one switch after the other switch is turned off and thus generates the necessary resonant transition intervals for the ZVS of the two switches. The resistor R and diode D parallel branch provides an asymmetrical time constant (polarized) together with the capacitor C. For example, the polarized RC time delay network in the drive circuit for switch Q1 poses a delay determined by RC time constant for the leading edge of the PWM signal but does not generate any time delay for the trailing edge because of the diode D. Therefore only turn-on of switch Q1 is delayed while turn-off of Q1 still follows trailing edge of PWM signal. Same explanations apply to switch Q2 and two resonant transition intervals ($tr_1$ and $tr_2$) are thus generated. Other time delay circuits including delay line and zero voltage detection circuit can be also used in the drive circuit of the present invention to provide the two resonant transition intervals ($tr_1$ and $tr_2$) for the extra feature of ZVS of the two switches.

It has been shown in Eq. (11) that neat unity input power factor can be achieved provided the ballast is operated in DICM and at constant duty ratio and constant switching frequency. However the gas discharge lamp as a load does not require first regulation, therefore a conventional feedback loop from lamp current to the switch duty ratio can be closed as long as the feedback is slow enough so that duty ratio D in Eq. (11) can be considered to be constant during each line period and thus high input power factor is still maintained. Thus, conventional PWM control can be used to regulate the lamp current against various disturbances, such as line voltage variations.

The fluorescent lamp current $i_L$ is nearly sine-wave ac due to the band-pass characteristic of the LCC circuit. Thus the lamp current $i_L$ can be approximately determined by the fundamental component of the square-wave voltage $v_{A-B1}$ which is a function of the magnitude $V_C$ and the duty ratio D as shown in Eqs. (1) and (2) (here $V_c=V_{dc}$), where lamp current $i_L=i_o$ in ideal case. Thus it can be seen that lamp current $i_L$ is the largest at the fifty percent duty ratio (D=0.5) and is reduced by reducing D for the fixed magnitude of $v_{A-B1}$. Also lamp current is proportional to the magnitude of the square-wave voltage $v_{A-B1}$ for the fixed duty ratio D. On the other hand, the input power and energy storage voltage $V_c$ is also regulated by the duty ratio D. Hence when the feedback loop is closed from the lamp current to the switch duty cycle, the controlling variable D also adjusts $V_c$ or the magnitude of $v_{A-B1}$. Therefore lamp current $i_L$ is regulated by D and thus $V_c$ in the present invention, which makes the control more sensitive compared to the two stage circuits with separate control where only duty ratio D or dc link voltage $V_c$ is adjusted.

For example, if D is reduced, then $V_c$ is also correspondingly reduced, and this reduced $V_c$ together with the reduced D make the lamp current reduced further. Therefore smaller range of change for the duty ratio D is achieved, which has the advantages of easy construction of isolated drive for the MOSFET and large ZVS range. The key of this efficient control is not to regulate the intermediate voltage $V_c$ but to monitor the lamp current directly. Another benefit is that the voltage stress of the switches are reduced at small duty ratio due to the reduced $V_c$, especially when the lamp is significantly dimmed. Thus the corresponding switching loss is also reduced when the lamp is dimmed and the zero voltage switching can not be realized. Reference voltage at the PWM controller can be adjusted to continuously vary the lamp light output. Thus the dimming function of the ballast is implemented simply and efficiently in the embodiment of FIGS. 5, 6(*a*) and (*b*) and other embodiments described below.

Fixed frequency with duty cycle modulation is adopted in the present invention to regulate the lamp current against the line voltage variations. For example, if line voltage drops, then lamp current $i_L$ drops correspondingly. When reduction of the lamp current is sensed, the feedback loop will increase the duty ratio D to correct it. Increased D with correspondingly increased $V_c$ will in turn increase lamp current $i_L$ to compensate the change and vise versa. On the other hand, adjustment of reference voltage in the PWM controller will adjust the duty ratio D, and then vary the lamp current. The light is thus dimmed both for open-loop and close-loop operation.

Dimming control as just described can be modified by so implementing the variable reference voltage that it may be remotely set for all lamps in a building from a central location, or for individual lamps at the central location, such that all the ballast and lamp fixtures can be controlled by a central panel. Benefits of the fixed frequency, duty ratio modulation control used in the present invention include easy circuit design and harmonics filtering. In addition, this simple and effective control can be implemented with a commercially available integrated circuit PWM chip which keeps the ballast cost to a minimum. Another benefit of fixed frequency operation is that the lamp can be started at the dimmed mode directly without generating flash.

As noted above, the present invention consists of four parts as shown in FIGS. 5, 6(*a*) and (*b*), namely an input network, a single conversion stage, a resonant matching network and a PWM controller. The input network converts the sine-wave line voltage to the unidirectional rectified sine-wave voltage and couples it to the conversion stage, and simultaneously unfolds the unidirectional input current $i_1$ of the conversion stage into the sine-wave current $i_G$ on the line. The input network includes an ordinary bridge rectifier, which provides the rectified line voltage to the single conversion stage, and a low pass filter which attenuates the high frequency switching ripple and averages the input current on the switching period to obtain the clean line current.

Figure 12B:
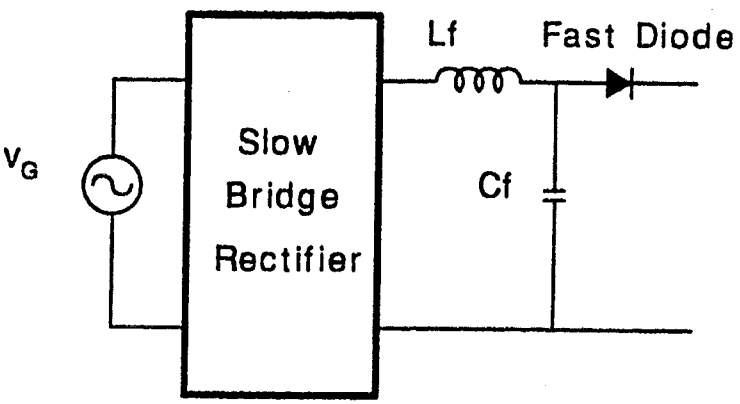
FIGS. 12(*a*), and (*b*) show schematic diagrams of the examples of the input network for the present invention of FIGS. 5, 6(*a*), 6(*b*), 13, 14(*a*), 14(*b*) and 15.
Figure 12A:
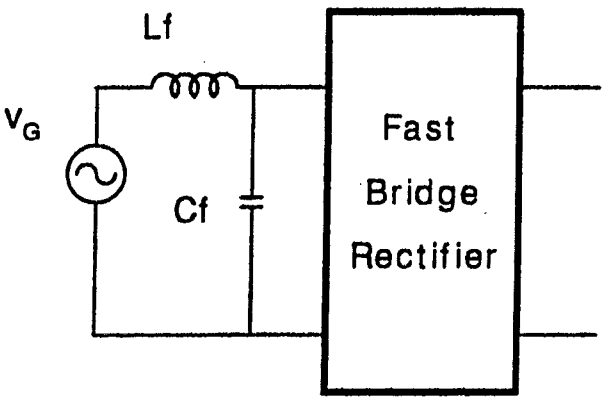

As shown in FIGS. 4, 5, 6(*a*) and (*b*), the front-end diode D1 is necessary for the DICM operation of the input inductor current $i_1$. Therefore the diode D1 switches on and off at the switching frequency and thus needs to be a fast-recovery diode to avoid a turn-off loss due to the slow reverse recovery of the ordinary rectifying diode. On the other hand, since the fast-recovery diode D1 is in series with the slow bridge rectifier of line frequency in the input network, a bridge rectifier consisting of four fast-recovery diodes can be also adopted as shown in FIG. 12(*a*) which functions the same as the fast-recovery diode D1 and slow bridge rectifier in series as shown before. However, four fast-recovery diodes are more expensive than one fast-recovery diode plus a slow bridge rectifier although in the first case one diode and the corresponding conduction loss can be saved. The third alternative is to place the low-pass filter, which comprises Lf and CL between the slow bridge rectifier and the fast-recovery diode D1 as shown in FIG. 12(*b*). In addition, a voltage doubler rectifier and a low-pass filter may be used in the input network as well.

The single conversion stage, which is the main constituent part of the present invention, converts the rectified sine-wave voltage at the line frequency into a square-wave voltage at the switching frequency to feed the resonant matching network and simultaneously generate input inductor (L1) current $i_1$ whose average nearly follows the rectified sine-wave voltage $v_{in}$. The first preferred embodiment of the present invention shown in FIG. 5 is redrawn in FIG. 13 (without switch drive circuits) to show the conversion stage in which the energy transfer capacitor C connected between the switches Q1 and Q2 is split into C1 and C2 to create a connection point B2 between them, thus providing point B2 as well as points B1 and B3 to which the matching network can be connected. From the above analysis of FIG. 5 and 6(*b*), the lamp only sees the fundamental component of the high frequency square-wave input when the matching network is connected across the points A–B1. Therefore the matching network can also be connected across the points A–B2 or A–B3 since these three points B1, B2 and B3 share the same fundamental component and the only difference is the dc potential. For example, the LCC matching network can be placed across the points A–B2 and A–B3 as well as A–B1. Since points A–B2 does not have any dc component, a simple LC parallel resonant network as in FIG. 13(*c*) can be placed across it.

Figure 13:
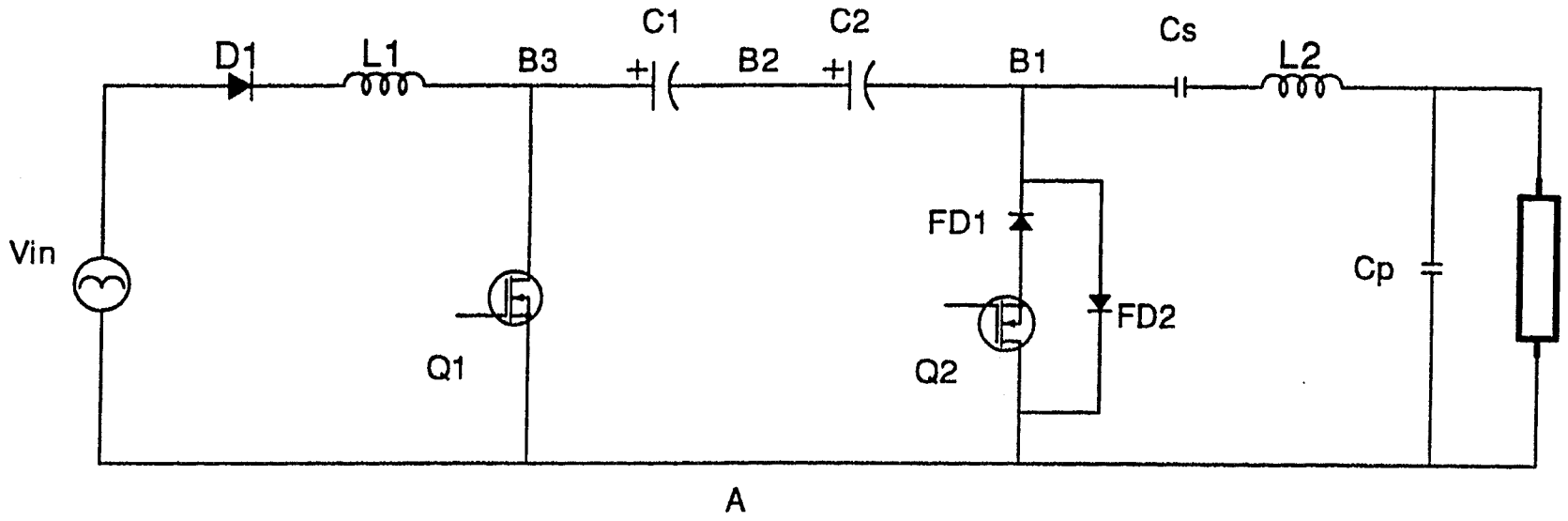
FIG. 13 is a schematic diagram of a first variant of the preferred embodiment of FIG. 5, which helps to understand other variations of the first preferred embodiment and FIGS. 13(*a*) and (*b*) are schematic diagrams of other examples of LCC resonant matching networks which can be adopted as variants of the present invention.
Figure 13A:
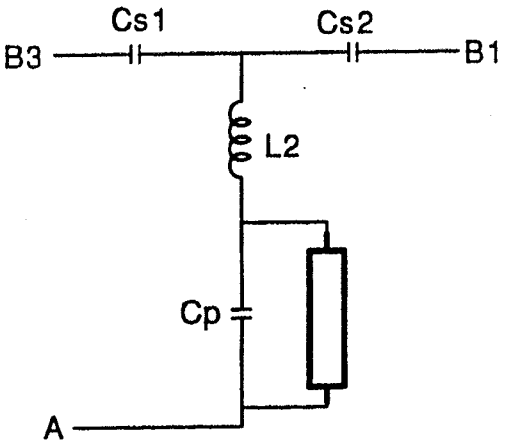
Figure 13B:
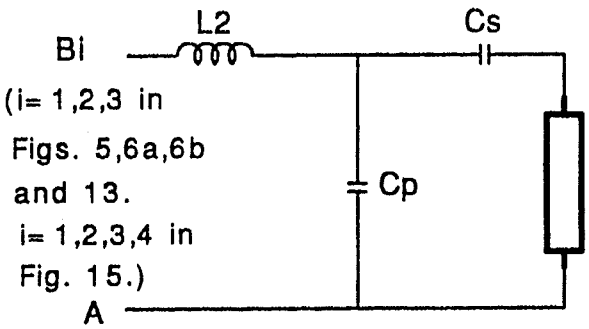
Figure 13C:
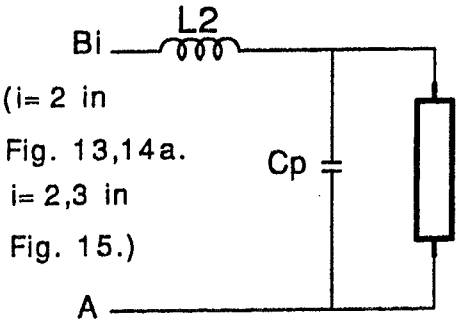
Figure 13D:
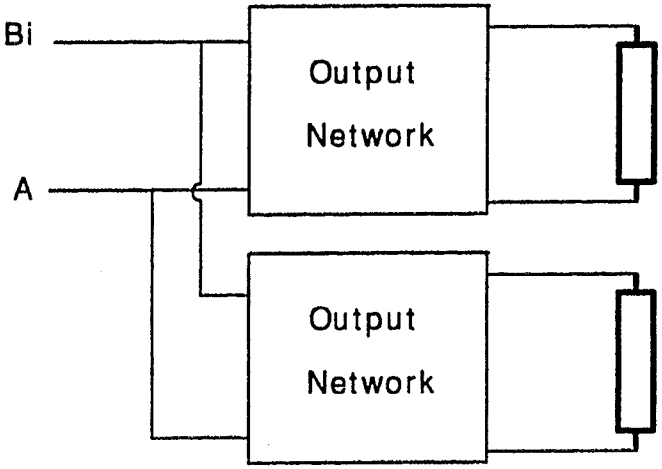
Figure 14A:
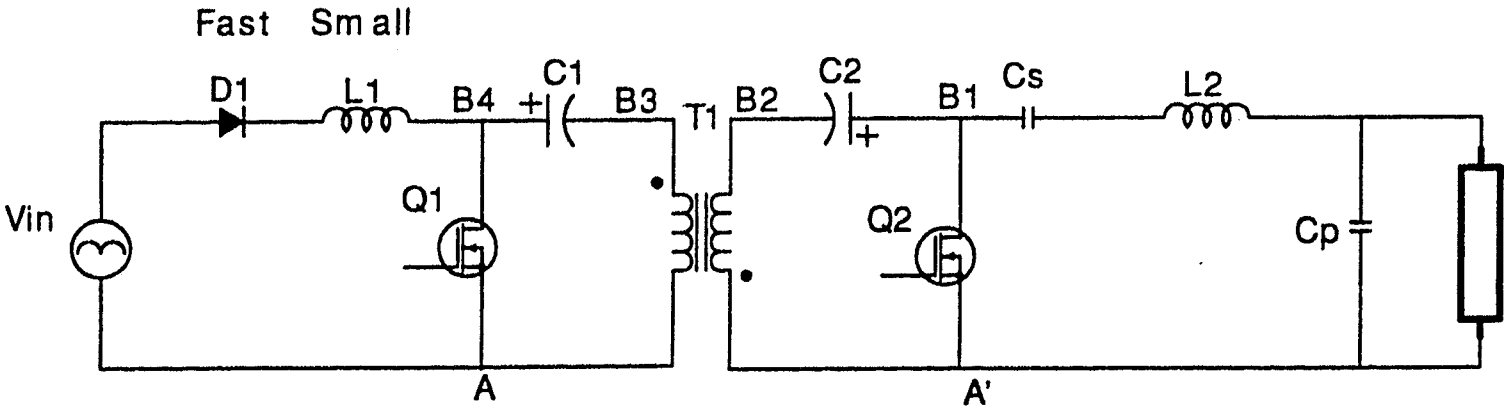
FIG. 14(*a*) is a schematic diagram of a second preferred embodiment of the present invention which provides dc isolation and a voltage step-up function, and FIG. 14(*b*) is another schematic diagram of the second preferred embodiment of the present invention which also provides dc isolation and a voltage step-up function.
Figure 14B:
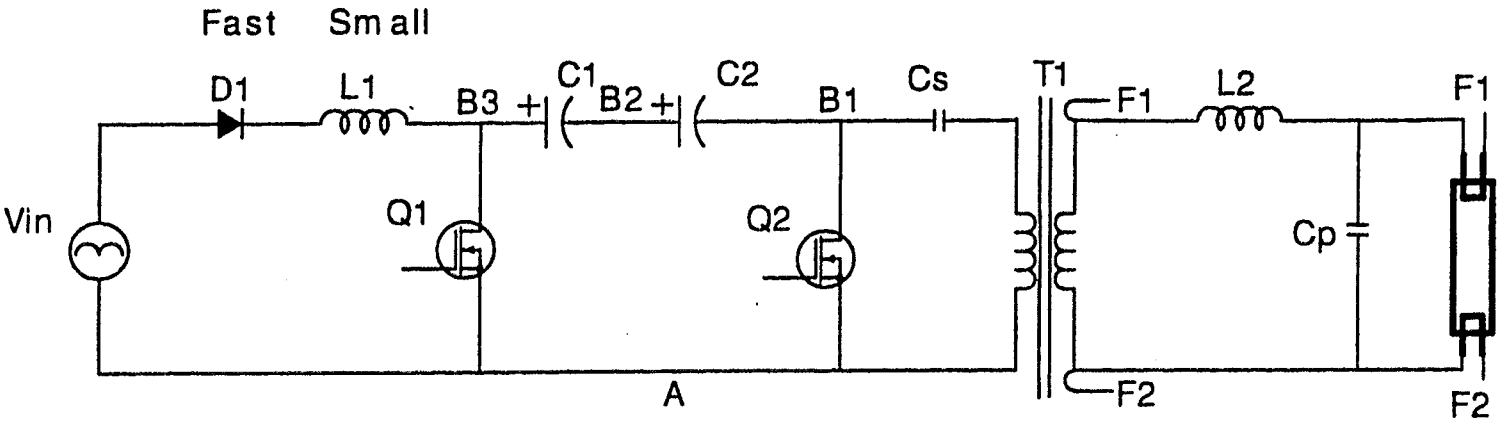
Figure 14D:
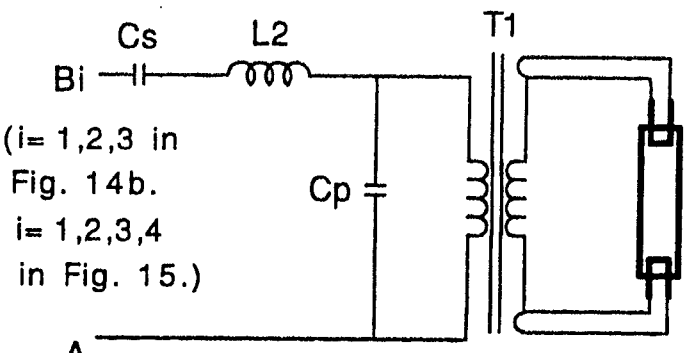
Figure 14C:
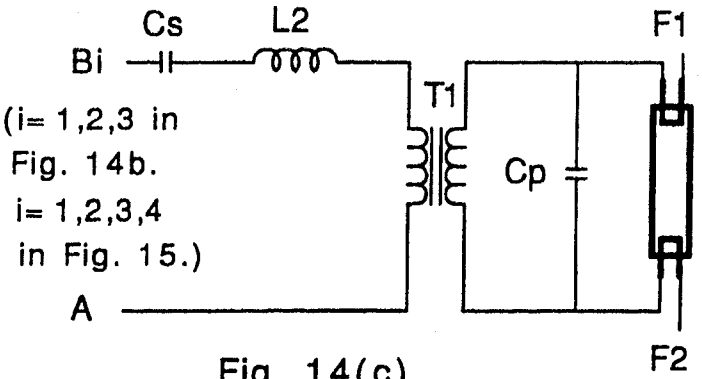
Figure 14E:
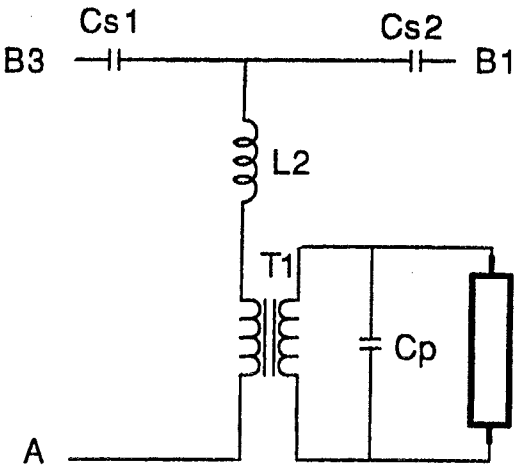

Another series-parallel resonant network which has three terminals with the dc blocking (series) capacitor split as shown in FIG. 13(*a*) can also be placed across the points A–B1–B3. In addition, other properly designed resonant matching networks which provide current source characteristic can be also adopted and placed at the above points to drive the fluorescent lamp. An example of other LCC matching networks is shown in FIG. 13(*b*). Isolated versions of the above circuit can be easily implemented simply by placing transformer-isolated versions of the above matching networks and are classified in the second preferred embodiment of the present invention. The above ballast network in FIGS. 13(*a*) and (*b*) can be also easily modified to drive a rapid start lamp with various filament heating schemes or used as a dimming ballast with separate filament heating coils and other auxiliary circuit to stabilize discharge and eliminate striations. Multilamp extensions are also easily made by cascading single lamps or paralleling resonant matching networks each with a single lamp in place, as shown in FIG. 13(*d*).

Note that in FIG. 13 two external fast-recovery diodes FD1 and FD2 are added to MOSFET switch Q2 when the ballast of the present invention is mainly used as a dimming ballast. When the lamp is dimmed to a significantly low level, lamp impedance $R_L$ is sufficiently large and the LCC resonant matching network is operated marginally above resonance. In that case, the reverse lagging current for the switch Q1 at the moment of its turn-on which provides ZVS does not exist, which means zero voltage turn-on of Q1 or zero voltage turn-off of Q2 is no longer available. On the other hand, duty ratio D is sufficiently small to achieve the corresponding low lamp current, so switch Q1 will both turn-on and off at the forward currents without conducting its internal antiparallel body diode during the short ON interval. Meanwhile, the ON interval for the switch Q2 is sufficiently large and thus Q2 will both turn on and off at the reverse current, i.e., the current through the switch Q2 will go through its internal antiparallel body diode first (reverse current) and then through the main channel of the switch (forward current) and then through its internal antiparallel body diode again (reverse current again) until the other switch Q1 turns on. Therefore substantial voltage $V_c$ will immediately apply across the antiparallel diode of switch Q2 after it turns off due to the hard switching-off of Q2, resulting in a turn-off loss because of its relatively slow reverse-recovery. To reduce the above switching loss, two extra fast-recovery diodes are added to the switch Q2 as shown in FIG. 13 with one (FD1) in series with Q2 so as to block its slow body diode and another (FD2) antiparallel across switch Q2 and diode FD1 in series to provide the reverse current path, where diode FD1 could be a schottky diode which has low ON voltage to reduce conduction loss.

Other properly designed resonant networks besides LCC which exhibit current source characteristics can be also used as matching network to drive the gas discharge lamp. Furthermore, various properly designed resonant networks including LCC can be also adopted in the present invention to drive other ac loads besides the gas discharge lamp. Fixed switching frequency PWM controllers or other types of controllers including variable switching frequency PWM (free-running) controllers can also be used. Thus, the present invention can be also applied to a single-stage high power factor line frequency ac to high frequency ac converter for other ac loads.

Second Preferred Embodiment

The second preferred embodiment of the present invention illustrated in FIGS. 14(*a*) and (*b*) is the isolated version of the first embodiment. It also comprises the input network, the single conversion stage, the resonant matching network and the controller. The single conversion stage of the second preferred embodiment of the present invention as shown in FIG. 14(*a*) is isolated by splitting the energy transfer capacitor C into capacitors C1 and C2, and inserting an isolation transformer T1 between them.

The line voltage $v_G$ is connected to the single conversion stage through a low-pass filter and a bridge rectifier. The bridge rectifier is to convert the line voltage into the positive rectified sine-wave voltage and simultaneously unfold the uni-directional input current $i_1$ into the sine-wave line current $i_G$ averaged by the low-pass filter where the undesirable high frequency switching ripple is attenuated. The above line voltage source $v_G$ together with the low-pass filter and the bridge rectifier form the input network of the present invention, which can be simply represented by a rectified sine-wave voltage source $v_{in}$ as shown in FIG. 14(*a*).

The output of the rectified sine-wave voltage source $v_{in}$ is connected to the fast-recovery diode D1 which is in series with the input inductor L1, while the other end of L1 at point B4, is connected to the first energy transfer capacitor C1 and (the drain of the) a first current bidirectional switch Q1 implemented by a direct drive n-channel MOSFET. The other end of the switch Q1, which is the source of the MOSFET, is connected to the primary side ground A. The other end of the capacitor C1 at the point B3 is connected to one end (dotted) of the primary side of the isolation transformer T1, while the other end of the transformer primary is connected to the primary ground A. One end of the secondary side of the transformer T1 is connected to the second energy transfer capacitor C2 while the other end (dotted) of the transformer secondary is connected to the secondary side ground A'. The other end of C2 is connected to the series capacitor Cs and (the drain of) a second current bidirectional switch Q2 implemented by a isolated drive n-channel MOSFET whose source is connected to the secondary ground A'.

The fast-recovery diode D1, input inductor L1, switches Q1 and Q2, capacitor C1 and C2 and transformer T1 form the conversion stage of the second preferred embodiment of the present invention, which converts the rectified line voltage to an isolated square-wave voltage at the switching frequency. Capacitor Cs is in series with the inductor L2, where the other end of L2 is connected to the shunting capacitor Cp and the fluorescent lamp. The other ends of both the capacitor Cp and fluorescent lamp are connected together and to the secondary side ground A'. The inductor L2, the capacitors Cs and Cp form the resonant matching network of the present invention. As in the first embodiment, the ballast of the present invention can be either operated in open-loop at the constant duty ratio and the constant switching frequency to provide the automatic current shaping at the input, or in closed-loop when a slow feedback loop is closed from the lamp current to the switch duty ratio without degrading the high input power factor. The conventional PWM chip can be used as the controller to regulate lamp current against the input line voltage variations. In particular, lamp current can be continuously adjusted by varying the reference voltage so that lamp dimming is easily provided. The above circuit forms the controller part of the second embodiment of the present invention.

The second embodiment retains all the advantages of the first embodiment as described and analyzed, namely both near unity power factor at the input and low crest factor lamp current free of line frequency modulation at the output are achieved in a single power conversion stage; simple fixed frequency PWM control either open-loop or closed-loop plus dimmable light output; extra feature of ZVS of switches by introducing two resonant transition intervals can be obtained as before. In addition, another feature of isolation is achieved in the second embodiment of the present invention. Another voltage step-up can be also obtained via the turns ratio of the isolation transformer when significantly high voltage is needed to start and operate the lamp. As shown in FIG. 14(*a*), the two split capacitors C1 and C2 block the dc component and automatically keeps the transformer volt-seconds balanced. Thus the transformer only deals with ac flux and can be made with an ungapped core and less windings and thus has small size and weight. Since the isolation transformer is volt-second balanced by the capacitors C1 and C2, there is no dc component between the secondary ground A' and point B2, therefore the simple parallel resonant matching network as in FIG. 13(*c*) can be also directly applied across the points A'–B2.

The isolation transformer T1 can be also inserted past the dc blocking (series) capacitor Cs as shown in FIG. 14(*b*). The whole ballast circuit is the same as in the first embodiment of the present invention except that the resonant matching network contains an isolation transformer. In addition, two extra windings may be provided to heat the filament for the rapid start lamp as shown. Insertions of the isolation transformer in the resonant matching network have the advantage that transformer parasitics can be combined into the resonant components so that the undesirable overshoot can be reduced to a minimum. Variations of the ballast as shown in FIGS. 13, 13(*a*), (*b*), (*c*) can be similarly applied to the ballast in FIG. 14(*b*), by placing the output transformer isolated resonant matching network at different points of the single conversion stage such as across points A–B1, A–B2 and A–B3, isolated three terminal ballast as in FIG. 14(*e*) can be also placed at points A–B1–B3. Note the isolation transformer can be inserted in several places in the resonant matching network as shown in FIGS. 14(*c*) and (*d*). The isolated resonant network can also be easily modified to drive rapid start lamps with other various filament heating schemes as well as to drive instant start lamps, or with separate filament heating coils and other auxiliary circuit to stabilize discharge and eliminate striations when the present invention is mainly used as a dimming ballast. Multilamp extensions can be easily made by either cascading single lamps or paralleling resonant matching networks each with a single lamp in place. External fast-recovery diodes can also be added as shown in FIG. 13 for the dimming ballast to reduce the reverse recovery loss of the relatively slow MOSFET body diode when ZVS can not be achieved at the low light output end or for the large input voltage variations.

Thus, the isolation feature as well as the voltage step-up function is fulfilled by the second preferred embodiment of the present invention. Other features like single-stage high power factor gas discharge lamp ballasting, simple PWM control either in open-loop and in closed-loop, dimmable light output and the extra feature of ZVS of the MOSFET switch are the same as in the first preferred embodiment of the present invention.

Other properly designed resonant networks (either isolated or nonisolated) besides LCC which exhibit current source characteristics can be also used as the matching network in ballast of FIG. 14(*a*) (nonisolated resonant networks) or FIG. 14(*b*) (isolated resonant networks) to drive the gas discharge lamp. The second preferred embodiment of the present invention can be also easily applied to a general isolated single-stage high power factor line frequency ac to high frequency ac converter for other ac loads, by placing various properly designed resonant networks including LCC and other ac loads besides the gas discharge lamp in the circuit of FIG. 14(*a*) and various transformer isolated resonant networks including LCC and other ac loads besides gas discharge lamp in the circuit of FIG. 14(*b*), either with fixed switching frequency PWM controller or other types of controller including variable switching frequency PWM (free-running) as mentioned in reference to the first preferred embodiment.

Third Preferred Embodiment

Figure 15:
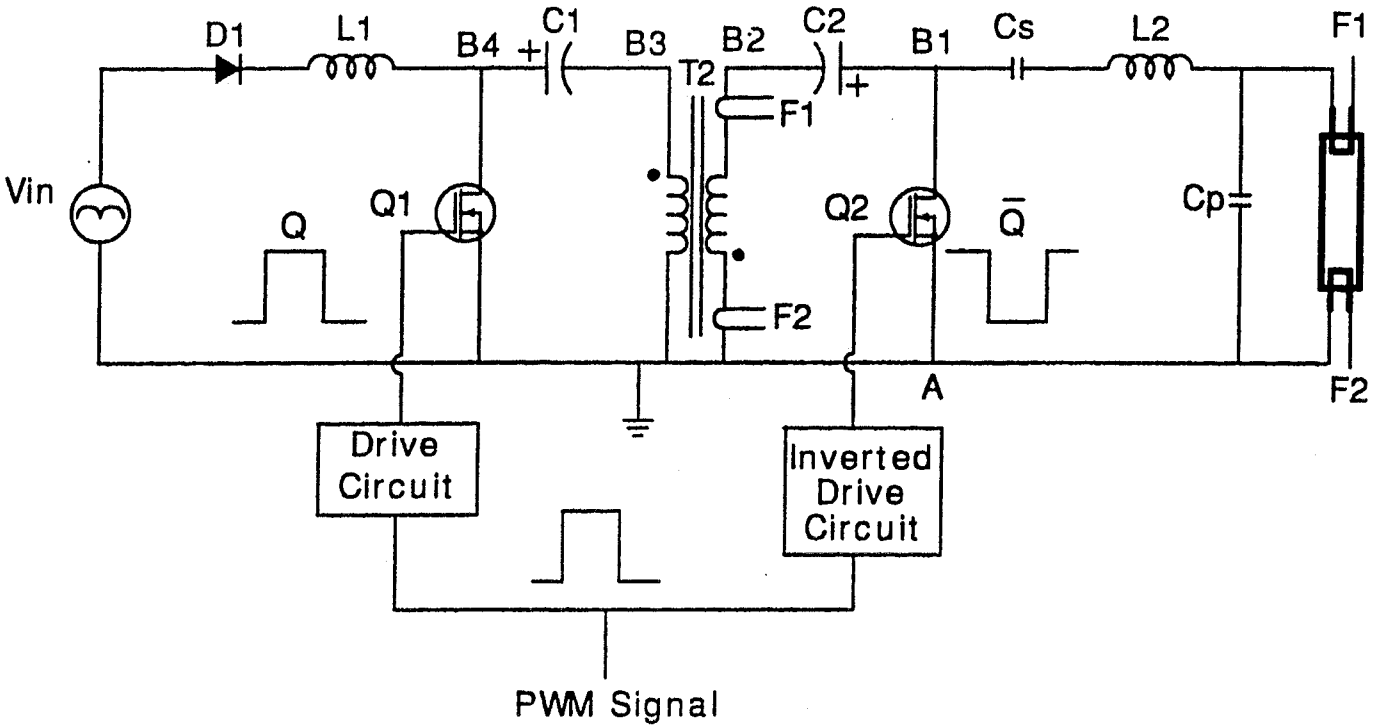
FIG. 15 is a schematic diagram of a third preferred embodiment of the present invention in which both transistor switches Q1 and Q2 are connected to a common ground, both of which can be implemented by n-channel MOSFETs with direct drive.

The third preferred embodiment of the present invention illustrated in FIG. 15 also comprises the input network, the single conversion stage, the resonant matching network and the controller. The single conversion stage has an ac transformer inserted between two split energy transfer capacitors C1 and C2 as before, but with its primary and the secondary reversely poled. Such a reversely poled connection brings an advantage that both current bidirectional switches can be implemented with the direct drive n-channel MOSFET which simplifies construction of the drive circuit.

The line voltage $v_G$ is connected to the single conversion stage through a low-pass filter and a bridge rectifier. The function of the bridge rectifier is, as before, to convert the line voltage into positive rectified sine-wave voltage and simultaneously unfold the unidirectional input current $i_1$ into the sine-wave line current $i_G$ averaged by the low-pass filter where the undesirable high frequency switching ripple is attenuated. The above line voltage source $v_o$, together with the low-pass filter and the bridge rectifier, form the input network of the third embodiment as well, which can be simply represented as before by a rectified sine-wave voltage source $v_{in}$ as shown in FIG. 15.

The output of the rectified sine-wave voltage source $v_{in}$ is connected to the fast-recovery diode D1 which is in series with the input inductor L1, while the other end of L1, which is the point B4, is connected to the first energy transfer capacitor C1 and (the drain of) a first current bidirectional switch Q1 implemented by a direct drive n-channel MOSFET, the other end of the switch which is the source of the MOSFET is connected to the ground A. The other end of the capacitor C1 which is the point B3, is connected to one (dot) end of the primary side of the isolation transformer T2 while the other end of the transformer primary is connected to the ground A. One end of the secondary side of the transformer is connected to the second energy transfer capacitor C2 and the other (dot) end is also connected to the ground A since the primary side and secondary side of the transformer T2 are reversely connected. The other end of C2 is connected to the series capacitor Cs and (the drain of) a second current bidirectional switch Q2 implemented by another direct drive n-channel MOSFET whose source is also connected to the ground A.

The fast-recovery diode D1, input inductor L1, switches Q1 and Q2, capacitor C1 and C2 and transformer T2 form the single conversion stage of the third preferred embodiment of the present invention, which converts the rectified sine-wave line voltage to the square-wave voltage at the switching frequency. Capacitor Cs is in series with the inductor L2, where the other end of L2 is connected to the shunting capacitor Cp and the fluorescent lamp. Both the other ends of the Cp and fluorescent lamp are connected together and to the ground A. The inductor L2 and the capacitors Cs and Cp form the matching network of the present invention. Like before, the ballast of the present invention can be either operated in open-loop at the constant duty ratio and the constant switching frequency to provide the automatic current shaping at the input, or in closed-loop when a slow feedback loop is closed from the lamp current to the switch duty ratio without degrading the high input power factor. The conventional PWM chip can be used as the controller to regulate lamp current against the input line voltage variations. Particularly, lamp current can be continuously adjusted by simply varying the voltage reference in the controller and lamp light is easily dimmed. The above circuit forms the controller part of the present invention.

The third embodiment retains all the advantages of the first embodiment as described and analyzed above—both near unity power factor at the input and low crest factor lamp current free of line frequency modulation at the output are achieved in a single power conversion stage; simple fixed frequency PWM control either in open-loop or in closed-loop plus dimmable light output; extra feature of ZVS of switches by introducing two resonant transition intervals can be also obtained as before. In addition, another feature is that both switches can be implemented by the direct drive n-channel MOSFET, which simplifies drive circuit construction. The two split capacitors C1 and C2 block the dc component and automatically keep the transformer volt-seconds balanced. Since the transformer only deals with ac flux, it can be made with an ungapped core and less windings. The result is small size and weight. Since the transformer is volt-second balanced by the capacitors C1 and C2, there is no dc component between the points A and B2 or B3, therefore a parallel resonant matching network as shown in FIG. 13(*c*) can be directly applied across the points A–B2 or A–B3.

Variations of the ballast as shown in first preferred embodiment (FIGS. 13, 13(*a*), (*b*) and (*c*)) and second embodiment (FIGS. 14(*b*)–(*e*)) are completely applicable to the third embodiment. There are five output points now A, B1, B2, B3, B4 in the conversion stage. Therefore, as in the first and second embodiments, LCC and other resonant matching networks, or their isolated versions, can be placed at different output points of the single conversion stage to obtain the variants in the third preferred embodiment. Multilamp extensions can be easily made as before by either cascading single lamps or paralleling resonant matching networks each with a single lamp in place. External fast-recovery diodes can also be added as in FIG. 13 for the dimming ballast to reduce the reverse recovery loss of the relatively slow MOSFET body diode when ZVS can not be achieved at the low light output end or for the large input voltage variations.

Thus both current bidirectional switches can be implemented by direct drive n-channel MOSFETs which simplifies drive circuit design in the third embodiment. Other features like single-stage high power factor gas discharge lamp ballasting, simple PWM control, dimmable light output and the extra feature of ZVS of the MOSFET switch are the same as in the first embodiment.

Other properly designed resonant networks (either isolated or nonisolated) besides LCC which exhibit current source characteristics can be also used as the matching network in the lamp ballast of FIG. 15 to drive the gas discharge lamp. As in the first and second embodiments described above, the third embodiment can be also easily applied as a general single-stage high power factor line frequency ac to high frequency ac converter for other ac loads with both current bidirectional switches implemented with direct drive n-channel MOSFETs. That is readily done by placing various resonant networks, including LCC and their transformer isolated versions, together with other ac loads besides the gas discharge lamp in the converter of FIG. 15, with fixed frequency PWM controller or other types of controllers including variable frequency PWM (free-running) as mentioned in the first preferred embodiment.

Experimental Result

The single-stage high power factor gas discharge lamp ballast, and particularly a fluorescent lamp ballast of the present invention and its variants have been experimentally tested. The primary function of the present invention, which is to achieve a near unity power factor at the input, low crest factor sine-wave lamp current free of line frequency modulation on the output, controllable lamp current against input voltage variations and continuously variable lamp current, or for the particular application a dimmable light output, have been experimentally verified. Other features such as zero voltage switching, isolation and extra voltage step-up, dual direct drive n-channel MOSFET switches and adding of external fast-recovery diodes reducing reverse recovery loss of the relatively slow body diode of the MOSFET have also been experimentally verified. Major results and wave forms will now be presented with a description of the experimental circuit shown in FIG. 16 which is yet another embodiment of the present invention.

Figure 1A:
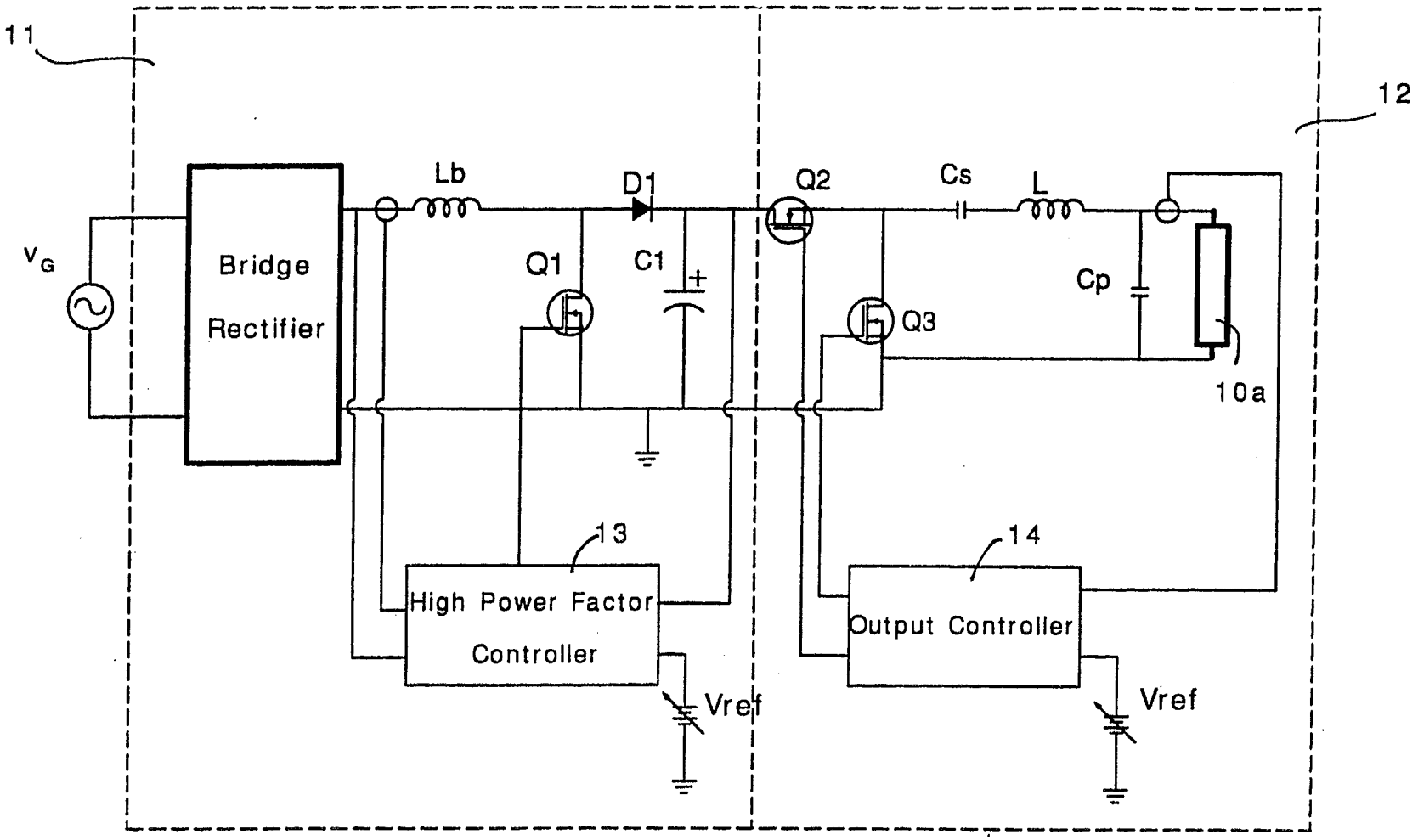
FIGS. 1(*a*) and (*b*) are schematic diagrams of prior-art high frequency electronic ballasts which include a boost ac-to-dc power factor correction stage, a resonant inverter and its LCC resonant matching network.
Figure 1B:
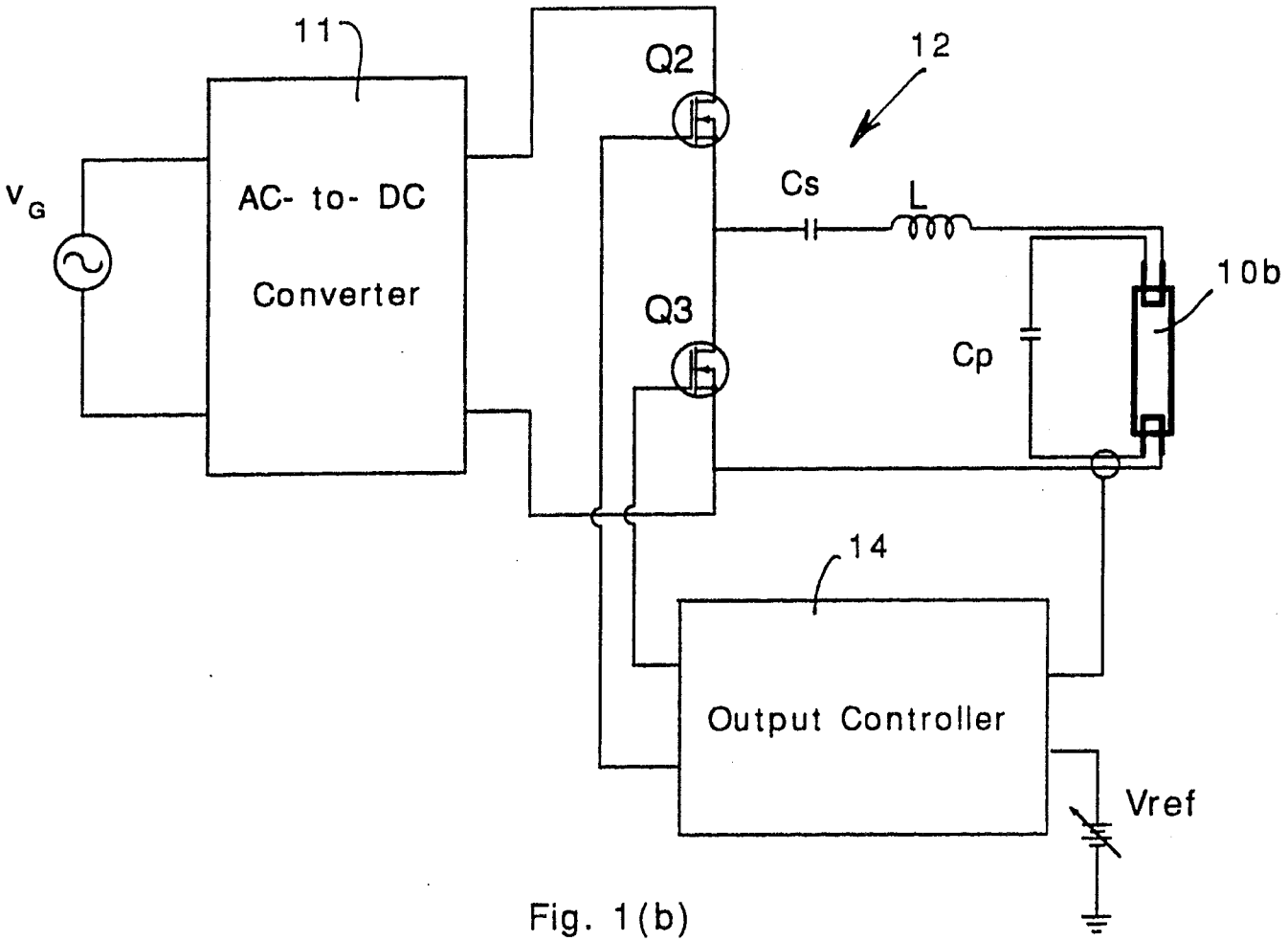
Figures 16, 16A:
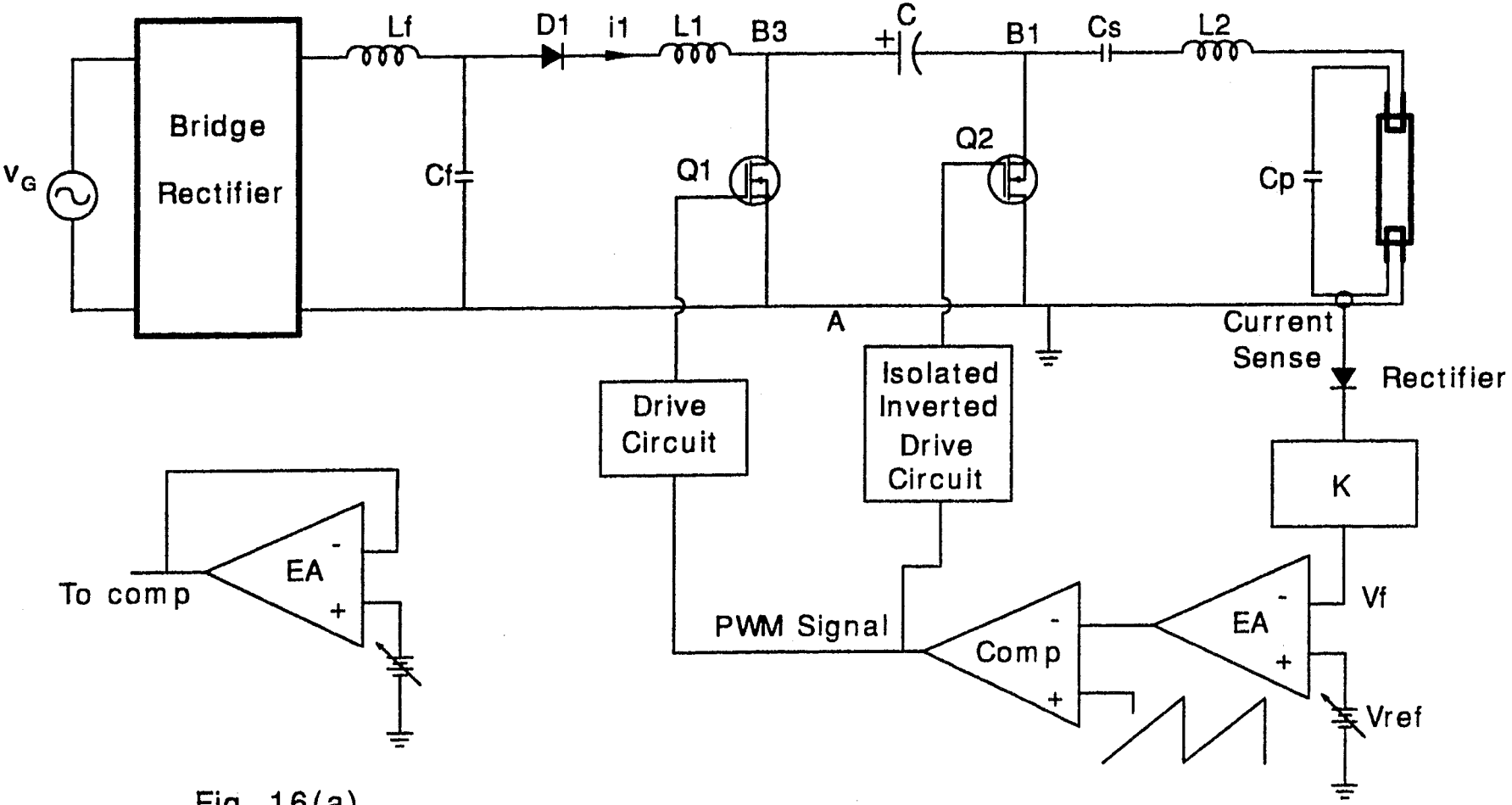
FIG. 16 is a schematic diagram of an experimental circuit of the present invention embodying the example of the input network of FIG. 12(*b*) in the first preferred embodiment with a commercial integrated circuit PWM controller in a closed-feedback loop.
Figure 17A:
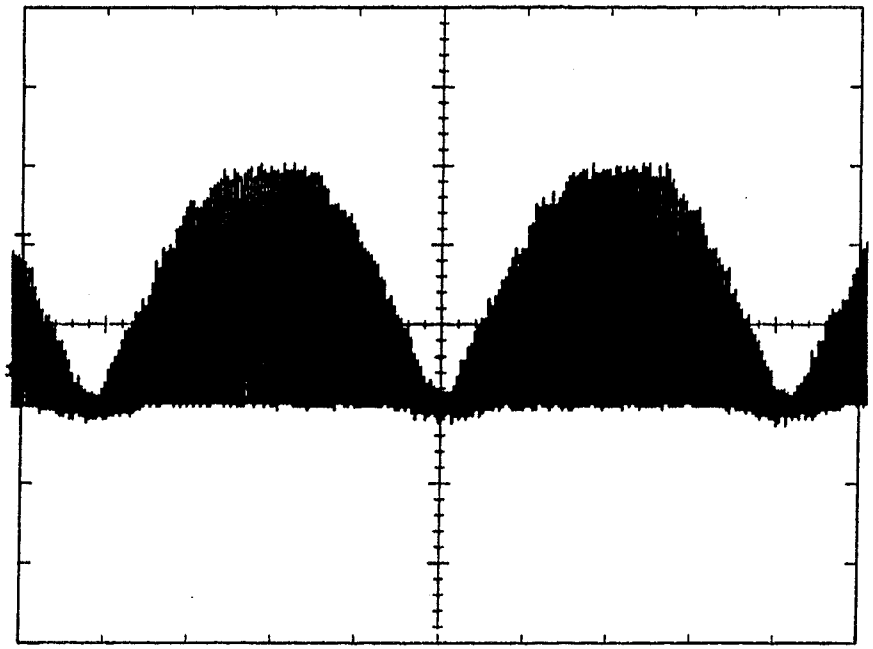
FIGS. 17(*a*), (*b*), (*c*), (*d*) and (*e*) are measured wave forms showing the novel function of the single-stage high power factor gas discharge lamp ballast of FIG. 16 operating at near unity power factor with and without the extra feature of zero voltage switching to reduce switching losses and noise.
Figure 17A:
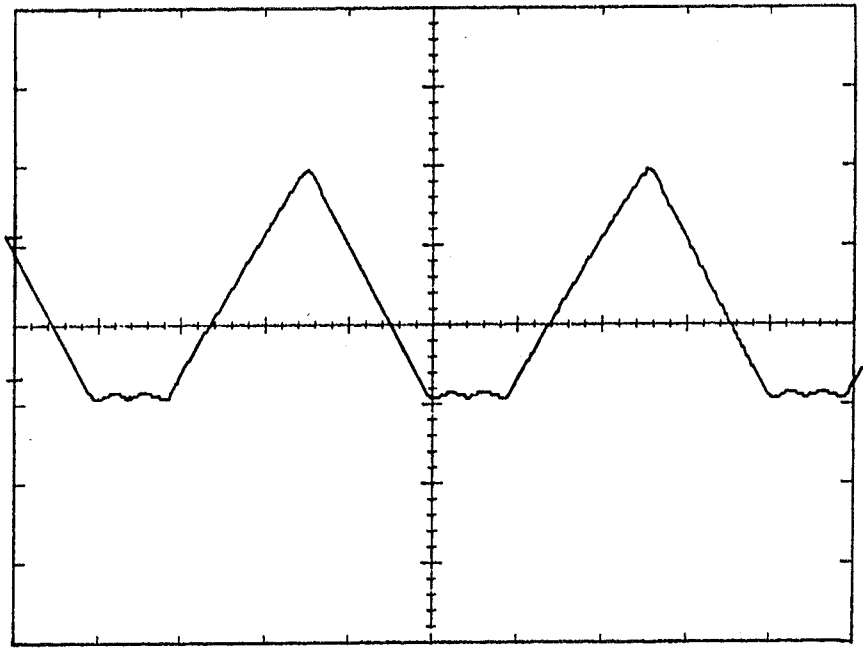
Figure 17B:
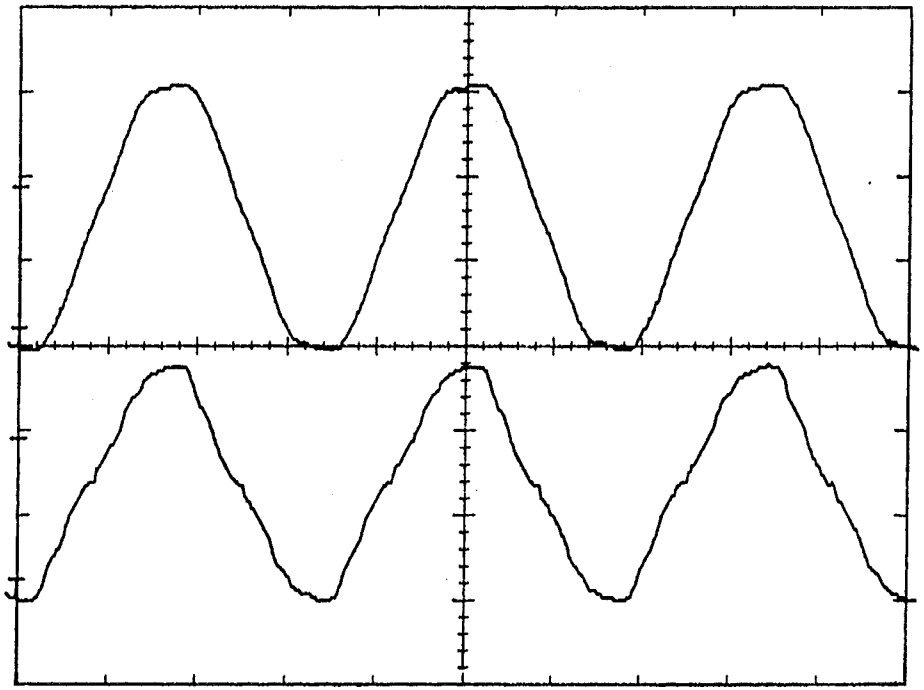
Figure 17C:
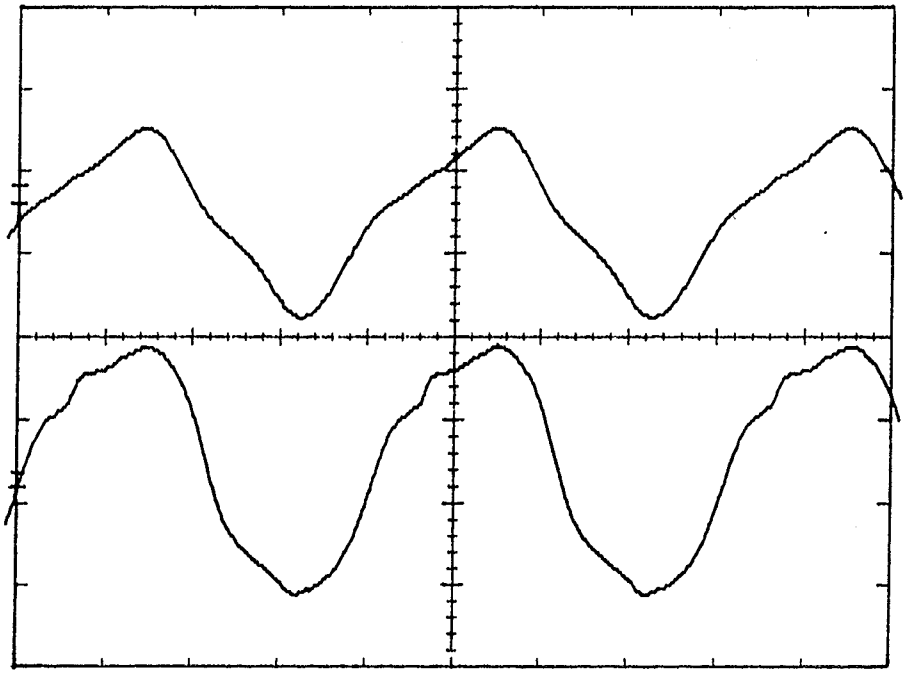
Figure 17D:
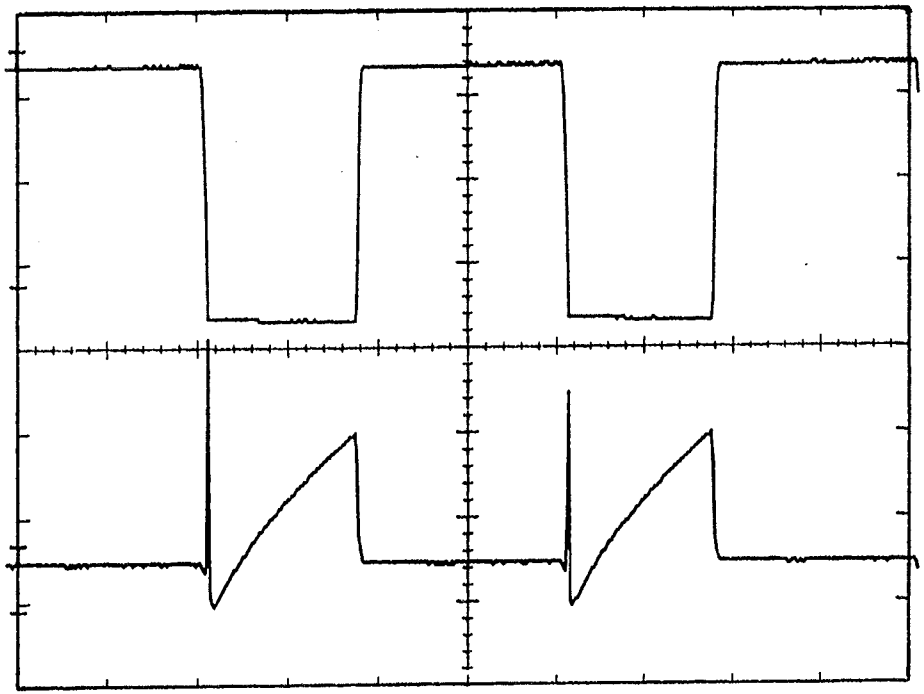
Figure 17E:
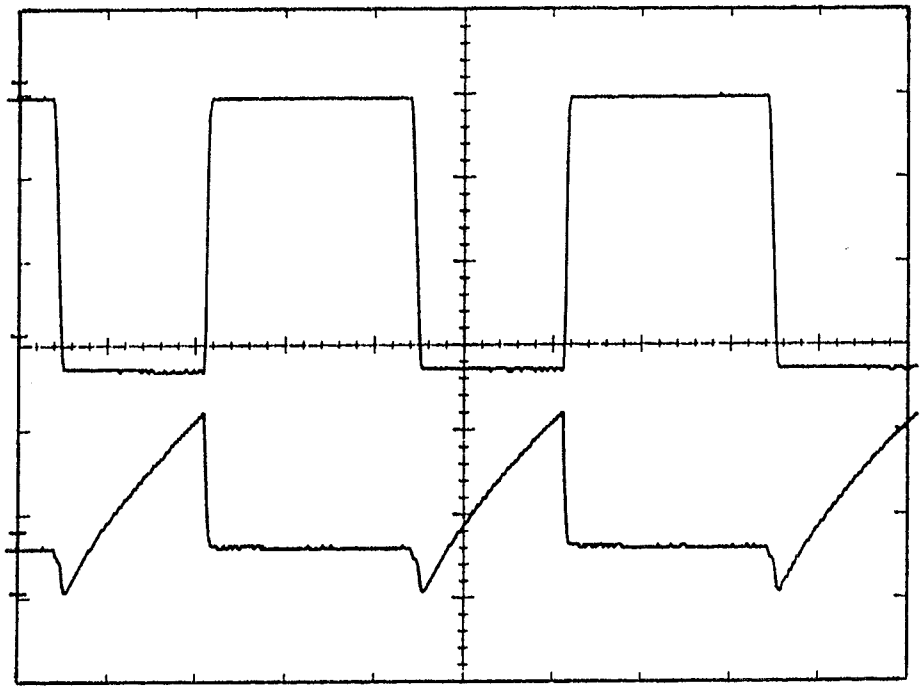

Referring to FIG. 16, the line voltage $V_G = V_M \mathrm{Sin}(\omega_L t)$ is connected to a low-pass filter consisting of inductance and capacitance Lf and Cf through a slow bridge rectifier. The output of the low-pass filter is connected to the fast-recovery diode D1, which is in series with the input inductor L1 as shown in FIG. 12(*b*). The other end of the input inductor L1 which is at the point B3 is connected to the first current bidirectional switch Q1 implemented by the direct drive n-channel MOSFET and to the storage (energy transfer) capacitor C. The other end of the capacitance C which is at the point B1 is connected to the second current bidirectional switch Q2 implemented by the isolated drive n-channel MOSFET and to the series resonant capacitor Cs. Both of the two MOSFET switches are connected to circuit ground A which is the return current path for the resonant inductor (L2) current via switch Q1 and the source via the fast-recovery diode D1 and the switch Q2. The capacitance Cs is connected to the resonant inductance L2, while the other end of inductance L2 is connected to the parallel combination of the parallel resonant capacitance Cp and a rapid start fluorescent lamp connected as in FIG. 1(*b*). The lamp current is sensed and rectified, and then fed back via a voltage dividing network K to an error amplifier EA where it is converted to a linearly proportional voltage $V_f$ for comparison with a reference voltage $V_{ref}$. The output of the error amplifier is compared with an oscillation ramp from a ramp generator operating at a constant frequency and thus the drive train of pulses is generated as a PWM signal. The PWM signal is then fed to a direct drive circuit and a separate (isolated) pulse inverting drive circuit as in FIG. 6(*b*) to drive the two switches Q1 and Q2, i.e., to turn the switches Q1 and Q2 on alternately.

The components used in the prototype are as follows: bridge rectifier: VH248, low-pass filter, Lf: 160 μH, Cf: 0.5 μF/200 V, fast-recovery diode D1: 50wF40F(reverse recovery time: 40 ns); Conversion stage: input inductor L1: 1.90 mH(gapped), two MOSFET switches: IRF840, energy transfer capacitor C 80 μF/450 VDC; Matching network: series resonant capacitor Cs: 100 nF/400 V, resonant inductor L2: 1.95 mt/(ungapped), parallel resonant capacitor Cp: 5.3 nF/600 V; fluorescent lamp: Sylvania Octron 17 W. Controller part including the error amplifier and the duty ratio generator can be implemented with any conventional PWM chip (UC3525 was used in the circuit) where the variable reference can be used to adjust the lamp current. Driving circuits including MOSFET driver DS0026, which provides sufficient current to turn on and off MOSFETs Q1, and Q2, and simple polarized RC time delay network to generate the necessary resonant transition time to implement ZVS of Q1 and Q2. Isolated drive for Q2 is also provided in the driving circuit.

Various measurements have been made and waveforms have been drawn as shown in FIG. 17. These results have verified all the predictions described previously of the present invention. The input inductor current $i_1$ is shown in FIG. 17(*a*) both on the switching scale and the line scale which clearly shows the DICM operation of the input inductor current $i_1$ and its peak follows the rectified sine-wave input voltage. This input inductor current shown as $i_1$ in FIG. 16 is averaged by the input low-pass filter Lf, Cf, which results in the line current $i_G$ nearly following the line voltage $v_G$ as shown in FIG. 17(*b*). Therefore near unity power factor is achieved. On the other hand, low crest factor sine-wave-like lamp current $i_L$ is also achieved at the output of the present invention by the LCC resonant circuit Cs, L2, Cp. Both lamp current $i_L$ and lamp voltage $v_L$ on the switching scale are shown in FIG. 17(*c*). As shown before, the lamp current it has minimum line frequency modulation for large enough capacitance C. It can be seen from the circuit that the line frequency modulation on the lamp current is negligible. The current $i_{Q1}$ through the switch Q1 and the voltage $v_{B3-A}$ across the first switch Q1 is demonstrated in FIG. 17(*d*), in which switch currents are the stun of the two inductor currents $i_1$ and $i_2$, and the magnitude of the square-wave voltage across the two switches is the energy transfer capacitor voltage $V_C$. The same analysis and measurement of current $i_{Q2}$ applies with the enhanced result due to discharge current of L1. Reference voltage at the error amplifier can be adjusted to continuously vary the lamp current, for the current prototype, maximum lamp current $i_L$ of 250 mA rms. at duty ratio 0.46 can be adjusted continuously to less than 10 mA at the duty ratio 0.05. Lamp can be also started naturally at the dimmed level (reduced light output) without generating any flash. Meanwhile, lamp current can be also effectively sensed and regulated by the PWM controller in the lamp current feedback loop. Therefore the basic functions of the single-stage near unity power factor gas discharge lamp ballast of the present invention have been experimentally verified and demonstrated.

As shown in FIG. 17(*d*), lagging current or reverse switch current at the beginning of the switch conduction can be utilized to implement another feature of the present invention, namely zero voltage switching, by introducing resonant transition time $tr_1$ and $tr_2$ in the drive circuit. The switch current $i_{Q1}$ and voltage $V_{B3-A}$ are again shown in FIG. 17(*e*) with the two resonant transitions introduced. It can be clearly seen that voltages across the two switches have been reduced to zero before their turn-on and the voltage overshoots (though it is not obvious without an isolation transformer) and current spikes have been eliminated at the beginning of the switch turn-on (or the other switch turn-off) as shown in FIG. 17(*d*) due to the capacitor charge dumping. Thus switching noise and turn-on loss have been significantly reduced. Both the leading and trailing edges of the switch voltage wave form can be rounded by adding external capacitor directly across the switch as a lossless snubber and switch-off loss can be also reduced.

All the functions and features of the single-stage high power factor gas discharge lamp ballast have been both theoretically analyzed and experimentally verified. The advantages of the present invention over the prior art are concluded below.

Advantages of the Present Invention

The single-stage high power factor gas discharge lamp ballast of the present invention achieves the advantages of near unity power factor and high frequency ballasting in a single power conversion stage. A sine-wave current at line frequency can be obtained at the input which provides near unity power factor and low harmonic distortions, while the low crest factor, high frequency sine-wave current free of line frequency modulation is also achieved at the output to ensure both long lamp life and low radiated EMI.

The desirable feature of zero voltage switching of the two current bidirectional switches in the present invention significantly reduces the switching losses and noise. Fixed-frequency operation either in the simple open-loop manner or in the conventional way of closed-loop duty ratio modulation provides a low cost method of regulating the lamp current against line voltage variations as well as provides another desirable feature of dimmable light output.

Compared to the prior-art two-stage ballasts, the single-stage high power factor gas discharge lamp ballast of the present invention significantly reduces the circuit complexity resulting in reduced size and weight so that circuit efficiency and reliability can be considerably increased.

The present invention can be also applied to a single-stage high power factor line frequency ac to high frequency ac converter for other ac loads.

We claim:

1. A single stage, high power factor, gas discharge lamp ballast comprising means for full-wave rectifying low frequency ac line voltage, said rectifying means including a low-pass filter, a single switching power conversion stage connected to said ac voltage rectifying means for convening rectified sine-wave line voltage to a square-wave voltage at a constant high switching frequency, $f_s$, and a resonant matching network for convening said square-wave voltage source into an ac sine-wave current source at said high switching frequency needed to drive said gas discharge lamp, said single power conversion stage comprising, an input inductor, and an energy transfer capacitor connected in series between said rectifying means and said resonant matching network, and switching means for alternately connecting a junction between said input inductor and energy transfer capacitor and a junction between said energy transfer capacitor and said resonant matching network to a return current path, and a fast recovery semiconductor diode inserted in series with said input inductor chosen to have an inductance $L_1$ to be less than a critical value of inductance, $L_{crit}$, for a given switching period $T_s$ at said constant high switching frequency, $f_s$, to force discontinuous inductor current mode of operation of said switching power conversion stage, said switching means comprising first and second current bidirectional switches driven out of phase such that, when said first current bidirectional switch is on, said second bidirectional switch is off, and vice versa, thus producing said square-wave high frequency voltage, said resonant matching network comprising means for converting said square-wave voltage source into sine-wave ac current source required by said gas discharge lamp, and for blocking any dc component of said square-wave voltage from reaching said gas discharge lamp, and switching control means for alternately turning on said first and second current bidirectional switches at a fixed switching frequency and a constant duty ratio in a mode of control selected from open-loop and closed-loop control of said high frequency ac current through said gas discharge lamp, whereby said input fast-recovery semiconductor diode, in conjunction with said input inductor chosen to be less than a predetermined critical inductance, forces said single stage power converter into a discontinuous inductor current mode of operation despite operation of said first and second switching means as bidirectional current switches, such that average input inductor current from said rectifying means filtered by said low-pass filter very closely follows instantaneous line voltage for near unity input power factor operation while operating at a fixed switching frequency and a constant duty ratio, and providing ac current lamp ballast.

2. A single stage, high power factor, gas discharge lamp ballast as defined in claim 1 wherein the function of said fast recovery semiconductor diode in series with said input inductor for said discontinuous inductor current mode of said single power conversion stage is implemented instead by using fast recovery semiconductor diodes for implementation of said full-wave rectifying means.

3. A single stage, high power factor, gas discharge lamp ballast as defined in claim 1 wherein said means for full-wave rectifying low frequency ac line voltage is implemented using slow recovery semiconductor diodes followed by said low-pass filter connected to said fast recovery semiconductor diode inserted in series with said input inductor.

4. A single stage, high power factor, gas discharge lamp ballast between an ac power line and a gas discharge lamp comprising means for full-wave rectifying low frequency ac line voltage, said rectifying means including a low-pass filter, a single switching power conversion stage connected to said ac voltage rectifying means for convening rectified sine-wave line voltage to a square-wave voltage at a constant high switching frequency, $f_s$, and a resonant matching network for converting said square-wave voltage source into an ac sine-wave current source at said high switching frequency needed to drive said gas discharge lamp, said single power conversion stage comprising an input inductor and an energy transfer capacitor connected in series between said rectifying means and said resonant matching network, and switching means for alternately connecting a junction between said input inductor and energy transfer capacitor and a junction between said energy transfer capacitor and said resonant matching network to a return current path, and fast recovery semiconductor diode means between said ac power line and said input inductor chosen to have an inductance $L_1$ to be less than a critical value of inductance, $L_{crit}$, for a given switching period $T_s$ at said constant high switching frequency, $f_s$, to force discontinuous inductor current mode of operation of said switching power conversion stage, said switching means comprising first and second current bidirectional switches driven out of phase such that, when said first current bidirectional switch is on, said second bidirectional switch is off, and vice versa, thus producing said square-wave high frequency voltage, said resonant matching network comprising means for converting said square-wave voltage source into sine-wave ac current source required by said gas discharge lamp, and for blocking any dc component of said square-wave voltage from reaching said gas discharge lamp, and switching control means for alternately turning on said first and second current bidirectional switches at a fixed switching frequency and a constant duty ratio in a mode of control selected from open-loop and closed-loop control of said ac current through said gas discharge lamp, whereby said fast recovery semiconductor means, in conjunction with said input inductor chosen to be less than a predetermined critical inductance, forces said single stage power converter into a discontinuous inductor current mode of operation despite operation of said first and second switching means as bidirectional current switches, such that average input inductor current from said rectifying means filtered by said low-pass filter very closely follows instantaneous line voltage for near unity power input factor operation while operating at a fixed switching frequency and a constant duty ratio, and providing ac current lamp ballast.

5. A single stage, high power factor, gas discharge lamp ballast as defined in claim 4 wherein said first and second current bidirectional switches individually tend to store energy in their parasitic capacitances while turned off, which would be immediately dissipated as a switching loss upon said first and second bidirectional transistor switches being alternately turned on, further comprising means form eliminating said switching loss by driving said first and second bidirectional transistor switches in such a way that the voltage across a switch previously off is reduced to zero before that switch is turned on by introducing a transition interval during which both said first and second bidirectional transistor switches are off before an alternate switch is turned on, thereby transferring stored energy between parasitic capacitances of said first and second bidirectional transistor switches while each is turned off and on, and utilizing negative values of lagging current of said matching network above resonance, to conserve energy that is otherwise dissipated as a switching loss by providing said transition interval during which both said first and second bidirectional transistor switches are turned off.

6. A single stage, high power factor, gas discharge lamp ballast as defined in claim 5 wherein each of said first and second current bidirectional switches of said switching means are implemented with semiconductor devices exhibiting a resonant transition interval of finite time that is short compared to the switching period of said high switching frequency, said resonant transition interval of each semiconductor device starting when it is turned off, whereby the resonant transition interval of each one of said first and second current bidirectional switches of said switching means facilitates alternately turning on said first and second current bidirectional switches only after both have been turned off for some time by utilizing said negative values of lagging current of said matching network above resonance to conserve energy.

7. A single stage, high power factor, gas discharge lamp ballast as defined in claim 6 wherein said semiconductor devices utilized to implement said first and second current bidirectional switches are MOSFET devices and a discrete snubber capacitor connected in parallel with one of said first and second current bidirectional MOSFET switches to reduce turn-off losses by slowing down voltage rise across said MOSFET switches.

8. A single stage, high power factor, gas discharge lamp ballast as defined in claim 4 wherein said resonant matching network comprises a dc blocking capacitor in series with said gas discharge lamp, a capacitor in parallel with said dc blocking capacitor and said gas discharge lamp in series, and an inductor connected at one end thereof to be in series with said capacitor in parallel with said dc blocking capacitor and gas discharge lamp in series, said inductor having its other end connected to a point selected from a group of points consisting of a point between said energy transfer capacitor and said current bidirectional switch, and a point between said first current bidirectional switch and said energy transfer capacitor.

9. A single stage, high power factor, gas discharge lamp ballast as defined in claim 4 wherein said energy transfer capacitor is divided into two capacitors connected in series and said resonant matching network comprises a capacitor connected in parallel with said gas discharge lamp and an inductor connected in series from a junction between said two capacitors to said gas discharge lamp.

10. A single stage, high power factor, gas discharge lamp ballast as defined in claim 4 wherein said resonant matching network comprises an isolation transformer, a dc blocking capacitor, an inductor, and a capacitor in parallel with said gas discharge lamp, said isolation transformer, dc blocking capacitor, inductor, and parallel capacitor being arranged in a series circuit from a junction between said energy transfer capacitor and second bidirectional switch to said return current path, said isolation transformer being connected for coupling between any two of said dc blocking capacitor, inductor, parallel capacitor and gas discharge lamp.

11. A single stage, high power factor, gas discharge lamp ballast as defined in claim 10 wherein said isolation transformer is connected for coupling between said dc blocking capacitor and said inductor.

12. A single stage, high power factor, gas discharge lamp ballast as defined in claim 10 wherein said isolation transformer is connected for coupling between said inductor and said parallel capacitor.

13. A single stage, high power factor, gas discharge lamp ballast as defined in claim 10 wherein said isolation transformer is connected for coupling between said parallel capacitor and said gas discharge lamp.

14. A single stage, high power factor, gas discharge lamp ballast as defined in claim 4 wherein said resonant matching network comprises a capacitor in parallel with said gas discharge lamp, a series inductor having a first terminal connected to said gas discharge lamp and a second terminal connected to first and second series capacitors, said first series capacitor connected to one side of said energy storage capacitor, and said second series capacitor connected to the other side of said energy storage capacitor, and each of said first and second series capacitors being connected to the other terminal of said inductor, thereby blocking any dc component of said square-wave voltage from reaching said gas discharge lamp.

15. A single stage, high power factor, gas discharge lamp ballast as defined in claim 4 wherein said resonant matching network comprises an isolation transformer, a capacitor connected in parallel with said gas discharge lamp and a secondary winding of said isolation transformer, an inductor connected in series to a first end of a primary winding of said isolation transformer, a second end of said primary winding being connected to said return current path, and two dc blocking capacitors coupling said inductor to both sides of said energy transfer capacitor, one dc blocking capacitor for coupling to one side and the other dc blocking capacitor for coupling to the other side of said energy transfer capacitor.

16. A single stage, high power factor, gas discharge lamp ballast as defined in claim 4 wherein said single power conversion stage includes an isolation transformer and said storage capacitor is divided into first and second energy storage capacitors, said first energy storage capacitor being connected in series with a primary winding of said isolation transformer at one end, the other end of said primary winding being connected to said return current path, and said second energy storage capacitor being connected in series between one end of a secondary winding of said isolation transformer and said resonant matching network, the other end of said secondary winding being connected to a return current path for said gas discharge lamp.

17. A single stage, high power factor, gas discharge lamp ballast as defined in claim 4 wherein said single power conversion stage includes an isolation transformer and said storage capacitor is divided into first and second energy storage capacitors, said first energy storage capacitor being connected in series with a primary winding of said isolation transformer at one end, the other end of said primary winding being connected to said return current path, and said second energy storage capacitor being connected in series between one end of said secondary winding of said isolation transformer and said resonant matching network, said resonant matching network comprising a capacitor in parallel with said gas discharge lamp, a dc blocking capacitor connected in series with said parallel capacitor and said gas discharge lamp, and an inductor connected in series between said one end of said secondary winding and said gas discharge lamp, and said resonant matching network is connected to a point between said second current bidirectional switch and said second energy transfer capacitor.

18. A single stage, high power factor, gas discharge lamp ballast as defined in claim 4 wherein said switching control means alternately turns said first and second current bidirectional switches on and off at a fixed switching frequency and a constant duty ratio in an open loop control mode, said switching control means comprising a pulse width modulator for controlling the duty ratio of each frequency switching cycle in proportion to a reference voltage, wherein a duty ratio comprises a period said first current bidirectional switch is turned on out of a complete switching frequency cycle of turning on and off said first current bidirectional switch and then alternately turning off and on said second current bidirectional switch.

19. A single stage, high power factor, gas discharge lamp ballast as defined in claim 18 including means for adjusting said reference voltage over a wide range for controlling light from said gas discharge lamp from a maximum bright level to a dim level.

20. A single stage, high power factor gas discharge lamp ballast as defined in claim 4 wherein said switching control means alternately turns said first and second current bidirectional switches on and off at a fixed switching frequency and a controlled duty ratio in a closed loop control mode, said switching control means comprising a pulse width modulator for controlling the duty ratio of each frequency switching cycle in proportion to a reference voltage, wherein a duty ratio comprises a period said first current bidirectional switch is turned on out of a complete switching frequency cycle of turning on and off said first current bidirectional switch and then alternately turning off and on said second current bidirectional switch, said pulse width modulator comprising means for sensing current through said gas discharge lamp, means for converting said sensed current to an output voltage for comparison with said reference voltage, means for comparing said output voltage with said reference voltage, and means for modulating said duty ratio in proportion to a difference between said output voltage and said reference voltage.

21. A single stage, high power factor, gas discharge lamp ballast as defined in claim 20 including means for adjusting said reference voltage over a wide range for controlling light from said gas discharge lamp from a maximum bright level to a dim level.

22. A single stage, high power factor, gas discharge lamp ballast as defined in claim 4 wherein said first and second current bidirectional switches are MOSFET devices and said second bidirectional current switch includes a first diode having fast recovery characteristics connected in series between said second current bidirectional switch and said second junction, and a second diode having fast recovery characteristics connected in antiparallel across said first bidirectional current switch and said first diode in series, said second diode being poled for reverse current to reduce turn-loss loss in switching said second bidirectional switch.

23. A single stage, high power factor, gas discharge lamp ballast as defined in claim 4 including an isolation transformer, wherein said energy transfer capacitor is divided into two energy transfer capacitors, a first one of said two energy transfer capacitors connected in series with a primary winding of said isolation transformer to a return current path from said load to said voltage source through circuit ground, and a second one of said two energy transfer capacitors connected in series with a secondary winding of said isolation transformer to a return current path from said load to said voltage source through said circuit ground, one end of said primary winding of said isolation transformer is connected to an inverted end of a secondary winding of said isolation transformer, and said one end of said primary winding and said inverted end of said secondary winding are connected to said return current path from said load to said voltage source through said circuit ground, said first and second current bidirectional switches are semiconductor transistors of the same conductivity type, and said switching control means for alternately turning on said first and second current bidirectional switches comprises memos for generating a train of switching pulses at a fixed frequency, a first pulse driver responsive to said train of switching pulses for turning on said first current bidirectional switch, and a second pulse driver responsive to said train of switching pulses for inverting said switching pulses and in response to the inverted train of switching pulses, turning on said second current bidirectional switch out of phase with the turning on of said first current bidirectional switch.

24. A single stage, high power factor, gas discharge lamp ballast as defined in claim 4 wherein said gas discharge lamp may be any ac load selected, and said resonant matching network is matched to said ac load.

25. A single stage, high power factor, gas discharge lamp ballast as defined in claim 4 wherein said resonant matching network comprises a capacitor in parallel with said gas discharge lamp, an inductor connected in series with said capacitor and said gas discharge lamp in parallel, and a dc blocking capacitor connected in series with said inductor to complete a series circuit to said return current path from either side of said energy transfer capacitor.

26. A single stage, high power factor, gas discharge lamp ballast as defined in claim 4 wherein said resonant matching network comprises an isolation transformer, a first blocking capacitor and a second blocking capacitor, an inductor and a capacitor in parallel with said gas discharge lamp, said isolation transformer inductor, and capacitor in parallel with said gas discharge lamp being arranged in a series circuit from a junction between said first dc blocking capacitor and said second dc blocking capacitor to said return current path, said first dc coupling capacitor being connected between said junction and one side of said energy transfer capacitor, and said second dc coupling capacitor being connected between said junction and a side of said energy transfer capacitor opposite said one side and said junction, and wherein said isolation transformer is connected for coupling between any two circuit elements consisting of said capacitor in parallel with said gas discharge lamp said inductor, and said first and second dc coupling capacitors considered as a unit connected to said junction.

* * * * *